US008387575B2

(12) United States Patent
Takahashi

(10) Patent No.: US 8,387,575 B2
(45) Date of Patent: Mar. 5, 2013

(54) VARIABLE VALVE APPARATUS, AND AN ENGINE APPARATUS AND A TRANSPORT MACHINE HAVING THE SAME

(75) Inventor: Toshihiko Takahashi, Shizuoka (JP)

(73) Assignee: Yamaha Hatsudoki Kabushiki Kaisha, Shizuoka (JP)

( * ) Notice: Subject to any disclaimer, the term of this patent is extended or adjusted under 35 U.S.C. 154(b) by 334 days.

(21) Appl. No.: 12/744,346

(22) PCT Filed: Oct. 13, 2009

(86) PCT No.: PCT/JP2009/005314

§ 371 (c)(1),
(2), (4) Date: May 24, 2010

(87) PCT Pub. No.: WO2010/061514

PCT Pub. Date: Jun. 3, 2010

(65) Prior Publication Data

US 2011/0048819 A1 Mar. 3, 2011

(30) Foreign Application Priority Data

Nov. 25, 2008 (JP) ..... 2008-299891
Nov. 25, 2008 (JP) ..... 2008-299892

(51) Int. Cl.
*F01L 1/34* (2006.01)
*F01L 1/18* (2006.01)

(52) U.S. Cl. ..... 123/90.16; 123/90.39; 123/90.41; 123/90.44

(58) Field of Classification Search ..... 123/90.16, 123/90.39, 90.41, 90.44
See application file for complete search history.

(56) References Cited

U.S. PATENT DOCUMENTS 4,523,550 A * 6/1985 Honda et al. ..... 123/90.16
4,911,112 A 3/1990 Oikawa et al.
6,467,444 B2 * 10/2002 Tanaka et al. ..... 123/90.16
(Continued)

FOREIGN PATENT DOCUMENTS

JP 2617343 B2 3/1997
JP 11-141322 A 5/1999
(Continued)

OTHER PUBLICATIONS

Official Communication issued in International Patent Application No. PCT/JP2009/005314, mailed on Nov. 17, 2009.

*Primary Examiner* — Thomas Denion
*Assistant Examiner* — Steven D Shipe
(74) *Attorney, Agent, or Firm* — Keating & Bennett, LLP

(57) ABSTRACT

In a variable valve apparatus, a second connector has a fifth side surface located below a fourth side surface and further away from a second side surface than is the fourth side surface, so that a width in a direction along a rocker shaft is narrower in a lower portion adjacent to an inlet valve than in an upper portion adjacent a slipper surface. A guide surface is provided in a lower portion of the fourth side surface and includes an arc that is shorter than a semicircle, and coaxial and equal in radius with an engaging hole. Thus, even when a connecting pin is advanced in a state of a through-hole and the engaging hole not being in precise alignment, the forward end of the connecting pin is guided through the guide surface into the engaging hole. An extended period can therefore be secured for advancing the connecting pin, to improve the certainty of connection.

15 Claims, 17 Drawing Sheets

U.S. PATENT DOCUMENTS 6,467,445 B1 * 10/2002 Harris ..... 123/90.16
6,481,398 B2 * 11/2002 Uchiyama ..... 123/90.16
6,502,536 B2 * 1/2003 Lee et al. ..... 123/90.16
6,901,894 B2 * 6/2005 Haas et al. ..... 123/90.16
7,201,125 B2 * 4/2007 Evans et al. ..... 123/90.39
2002/0139328 A1 10/2002 Uchiyama
2008/0230023 A1 * 9/2008 Sugiura et al. ..... 123/90.16

FOREIGN PATENT DOCUMENTS

JP 2002-303109 A 10/2002

* cited by examiner 45
103
107
33
91
60
59
109
105
111
101
301
59C
end of arc
63

State of base circle

State of maximum lift by cams for high speed

State of maximum lift by cams for low speed

VARIABLE VALVE APPARATUS, AND AN ENGINE APPARATUS AND A TRANSPORT MACHINE HAVING THE SAME

BACKGROUND OF THE INVENTION

1. Field of the Invention

The present invention relates to a variable valve apparatus, in an internal combustion engine including valves, which controls opening and closing of the valves, and an engine apparatus and a transport machine including the same, and more particularly to a technique for switching a lift amount of the valves between a time of low speed and a time of high speed.

2. Description of the Related Art

Conventionally, as this type of apparatus, there is a variable valve apparatus including a cam shaft having a cam for low speed and a cam for high speed, a rocker shaft interposed between the cam shaft and a valve, and having a rocker arm for low speed and a rocker arm for high speed, pinholes provided in the rocker arm for low speed and the rocker arm for high speed, and formed in positions close to the rocker shaft as seen from the axial direction of the rocker shaft, a switching pin slidably mounted in the pinholes, and a hydraulic piston for driving this switching pin (see Unexamined Patent Publication H11-141322 (FIGS. 2-5), for example).

This apparatus, with the switching pin withdrawn by the spring force of a coil spring, causes the rocker arm for high speed to rock idly, and causes only the rocker arm for low speed to act on a stem end surface of the valve. With the switching pin advanced by the hydraulic piston, the rocker arm for high speed and the rocker arm for low speed are interlocked for causing the rocker arm for low speed to act on the stem end surface of the valve with operation timing of the rocker arm for high speed. This can switch the rocker arm for low speed and the rocker arm for high speed for acting on the valve.

However, with the above construction, the forward end of the switching pin can collide with an opening edge of a pinhole, thereby failing to perform a connecting operation normally. A taper-like chamfer is formed on the opening edge of the pinhole so that the switching pin may advance to the pinhole easily (see U.S. Pat. No. 2,617,343 (FIG. 5), for example).

However, the conventional example with such construction has the following problem.

That is, the conventional apparatus, with the taper-like chamfer of the pinhole, facilitates advancement of the forward end of the switching pin. However, when the switching pin is advanced, the rocker arm for high speed can be pushed by the cam for high speed to flip the forward end of the switching pin at the time when the forward end of the switching pin contacts the tapered surface. Therefore, there is a problem of easily producing a situation where the rocker arm for low speed and the rocker arm for high speed cannot be connected. With such a low certainty of connection, it becomes impossible to acquire a desired operating state.

SUMMARY OF THE INVENTION

In view of the state of the art noted above, preferred embodiments of the present invention provide a variable valve apparatus, and an engine apparatus and a transport machine including the same, which includes a guide surface to improve the certainty of connection between a rocker arm for low speed and a rocker arm for high speed to thereby realize a desired operating state.

According to a preferred embodiment of the present invention, a variable valve apparatus for switching a lift amount of a valve between a time of low speed and a time of high speed includes a cam shaft supported rotatably and including, arranged around an axis thereof, a cam for low speed and a cam for high speed; a rocker shaft spaced from the cam shaft and extending parallel or substantially parallel to the cam shaft; a rocker arm for low speed mounted on the rocker shaft to be rockable about an axis thereof, which rocks in response to the cam for low speed and pushes a stem end surface of the valve; a through-hole provided in the rocker arm for low speed to be parallel or substantially parallel to the rocker shaft; a connecting pin slidably inserted in the through-hole; an actuator arranged to move the connecting pin back and forth within the through-hole; a rocker arm for high speed mounted on the rocker shaft to be rockable about the axis thereof, which rocks in response to the cam for high speed; and an engaging portion provided on the rocker arm for high speed to engage the connecting pin projecting from the through-hole; wherein the rocker arm for low speed includes a first cam receiver including a slipper surface slidable on the cam for low speed, and a first side surface arranged in a direction depending from an end of the slipper surface; and a first connector including a second side surface located closer to the valve than is the first side surface and perpendicular or substantially perpendicular to the rocker shaft, and including the through-hole provided therein; the rocker arm for high speed includes a second cam receiver including a slipper surface slidable on the cam for high speed, and a third side surface arranged in a direction depending from an end of the slipper surface; and a second connector integral with the second cam receiver and including a fourth side surface in a position opposed to the second side surface of the first connector, and including the engaging portion provided thereon; the engaging portion includes a cylindrical engaging hole having a central axis extending axially along the rocker shaft; and the second connector includes a fifth side surface located below the fourth side surface to be further remote from the second side surface than is the fourth side surface, such that a width in a direction of the rocker shaft is narrower in a lower portion adjacent the valve than in an upper portion adjacent the slipper surface, and a guide surface located in a lower portion of the fourth side surface and including an arc shorter than a semicircle, and coaxial and equal in radius with the engaging hole.

According to the present preferred embodiment, a guide surface is provided in a lower portion of the fourth side surface and includes an arc shorter than a semicircle. Thus, even when the connecting pin is advanced in a state of the through-hole and engaging hole not being in precise alignment, the forward end of the connecting pin is guided through the guide surface into the engaging hole. An extended period can therefore be secured for advancing the connecting pin, to improve the certainty of connection between the rocker arm for low speed and the rocker arm for high speed. As a result, a desired operating state can be acquired. Since a cylindrical engaging hole is provided as the engaging hole, it is not only easy to manufacture but can improve manufacturing accuracy, compared with the case of the engaging hole being semicircular or arcuate. Further, the second connector includes the fifth side surface such that the width in the direction of the rocker shaft is narrower in the lower portion than in the upper portion. Thus, there is no possibility of the rocker arm for high speed, at a time of idle rocking, interfering with an upper spring seat, a spring or the like. As a result, the rocker arm for high speed can be rocked to a large extent at the time of idle rocking, which allows an increased design freedom for the cam for high speed.

It is preferred that the through-hole is located forward of a rear end of the slipper surface of the rocker arm for high speed, as seen from an axial direction of the rocker shaft. As a result, the connecting pin which engages the rocker arm for high speed and the rocker arm for low speed is advanced from the through-hole located forward of a rear end of the slipper surface of the rocker arm for high-speed, as seen from the axial direction of the rocker shaft. Therefore, the distance, in a direction perpendicular or substantially perpendicular to the axis, from the connecting pin to the slipper surface of the rocker arm for high speed acted on by the cam for high speed can be shortened. Therefore, an amount of deflection occurring with the rocker arm for high speed can be reduced. As a result, since connecting rigidity in the engaging portion can be improved, a disagreement between the profile of the cam for high speed and the lift profile of the valve can be reduced to acquire an ideal operating state.

It is preferred that, as seen from an axial direction of the rocker shaft, at least a portion of the through-hole is located within a range of a sector defined by an arcuate portion, on which the cam for high speed slides, of the slipper surface of the rocker arm for high speed, and a center of a circle providing an arc of the slipper surface of the rocker arm for high speed. Thus, the connecting pin which engages the rocker arm for high speed and the rocker arm for low speed is advanced from the through-hole located adjacent a forward end of the rocker arm for high speed remote from the rocker shaft and below the slipper surface of the rocker arm for high speed, as seen from the axial direction of the rocker shaft. Therefore, the distance, in a direction perpendicular or substantially perpendicular to the axis, from the connecting pin to the slipper surface of the rocker arm for high speed acted on by the cam for high speed can be shortened as compared with the prior art. Therefore, an amount of deflection occurring with the rocker arm for high speed can be reduced. As a result, since connecting rigidity in the engaging portion can be improved, a disagreement between the profile of the cam for high speed and the lift profile of the valve can be reduced to acquire a desired operating state.

It is preferred that, as seen from an axial direction of the rocker shaft, at least a portion of the through-hole is located within a range of a sector defined by an arcuate portion, on which the stem end surface of the valve slides, of a valve-side slipper surface of the rocker arm for low speed, and a center of a circle providing an arc of the valve-side slipper surface of the rocker arm for low speed. As a result, the connecting pin which engages the rocker arm for high speed and the rocker arm for low speed is advanced from the through-hole located adjacent a forward end of the rocker arm for high speed remote from the rocker shaft, and above the valve-side slipper surface of the rocker arm for low speed, as seen from the axial direction of the rocker shaft. Therefore, the distance, in a direction perpendicular or substantially perpendicular to the axis, from the connecting pin to the slipper surface of the rocker arm for low speed which pushes the stem end surface of the valve can be shortened as compared with the prior art. Therefore, an amount of deflection occurring with the rocker arm for low speed can be reduced. As a result, since connecting rigidity in the engaging portion can be improved, a disagreement between the profile of the cam for high speed and the lift profile of the valve can be reduced to acquire a desired operating state.

It is preferred that, as seen from an axial direction of the rocker shaft, at least a portion of the through-hole is located within a range of a sector defined by an arcuate portion, on which the cam for high speed slides, of the slipper surface of the rocker arm for high speed, and a center of a circle providing an arc of the slipper surface of the rocker arm for high speed; and as seen from an axial direction of the rocker shaft, at least a portion of the through-hole is located within a range of a sector defined by an arcuate portion, on which the stem end surface of the valve slides, of a valve-side slipper surface of the rocker arm for low speed, and a center of a circle providing an arc of the valve-side slipper surface of the rocker arm for low speed. Accordingly, the connecting pin which engages the rocker arm for high speed and the rocker arm for low speed is advanced from the through-hole located adjacent a forward end of the rocker arm for high speed remote from the rocker shaft and below the slipper surface of the rocker arm for high speed, and adjacent a forward end of the rocker arm for low speed remote from the rocker shaft and above the valve-side slipper surface of the rocker arm for low speed, as seen from the axial direction of the rocker shaft. Therefore, the distance, in a direction perpendicular or substantially perpendicular to the axis, from the connecting pin to the slipper surface of the rocker arm for high speed acted on by the cam for high speed, and the distance, in a direction perpendicular or substantially perpendicular to the axis, from the connecting pin to the slipper surface of the rocker arm for low speed which is pushed by the stem end surface of the valve, can be shortened as compared with the prior art. Therefore, amounts of deflection occurring with both the rocker arm for high speed and the rocker arm for low speed can be reduced. As a result, since connecting rigidity in the engaging portion can be further improved, a disagreement between the profile of the cam for high speed and the lift profile of the valve can be further reduced to acquire a desired operating state.

It is preferred that an engine apparatus comprises the variable valve apparatus described above. Since the engine apparatus includes the variable valve apparatus which can improve the certainty of connection between the rocker arm for low speed and the rocker arm for high speed, the engine apparatus which can acquire a desired operating state can be realized.

According to another preferred embodiment of the present invention, a transport machine includes the engine apparatus described above, a fuel tank arranged to store fuel; a front wheel and a rear wheel; and a transmission mechanism arranged to transmit power generated by the engine apparatus to the rear wheel. Since the engine apparatus has the variable valve apparatus which can improve the certainty of connection between the rocker arm for low speed and the rocker arm for high speed, a transport machine which can acquire a desired operating state can be realized.

The "transport machine" herein refers to, for example, an automobile, two-wheeled motor vehicle, personal watercraft, snowmobile, boat and so on which are equipped with the engine apparatus and can transport people, baggage and so on.

With the variable valve apparatus according to a preferred embodiment of the present invention, a guide surface is arranged in a lower portion of a fourth side surface to include an arc shorter than a semicircle. Thus, even when a connecting pin is advanced in a state of a through-hole and an engaging hole not being in precise alignment, the forward end of the connecting pin is guided through the guide surface into the through-hole. An extended period can therefore be secured to advance the connecting pin, to improve the certainty of connection. As a result, a desired operating state can be acquired. Since a cylindrical engaging hole is provided as the through-hole, it is not only easy to manufacture but can improve manufacturing accuracy, compared with the case of the through-hole being semicircular or arcuate. Further, a second connector includes a fifth side surface such that the width in the direction of the rocker shaft is narrower in a lower portion than in an upper portion. Thus, there is no possibility of a rocker arm for high speed, at a time of idle rocking, interfering with an upper spring seat, a spring or the like. Therefore, the rocker arm for high speed can be rocked to a large extent at the time of idle rocking, which allows an increased design freedom for a cam for high speed.

These and other elements, features, steps, characteristics and advantages of the present invention will become more apparent from the following detailed description of the preferred embodiments with reference to the attached drawings.

BRIEF DESCRIPTION OF THE DRAWINGS

FIGS. 4A-4C are views showing the rocker arm for high speed, in which FIG. 4A is a side view of the rocker arm for high speed, FIG. 4B is a section taken along line 301-301 of FIG. 4A, and FIG. 4 C is a front view.

FIGS. 5A and 5B are views showing a cam shaft in a state of base circle, in which FIG. 5A is a section taken along line 302-302 of FIG. 5B, and FIG. 5B is a view seen from the axial direction of a rocker arm.

FIGS. 6A and 6B are views showing a state of maximum lift amount by cams for high speed, in which FIG. 6A is a section taken along line 303-303 of FIG. 6B, and FIG. 6B is a view seen from the axial direction of the rocker arm.

FIGS. 7A and 7B are views showing a state of maximum lift amount by cams for low speed, in which FIG. 7A is a section taken along line 304-304 of FIG. 7B, and FIG. 7B is a view seen from the axial direction of the rocker arm.

FIGS. 9A-9C are schematic views illustrating an advantage where an engaging hole is cylindrical, in which FIG. 9A shows a case of being simply cylindrical, FIG. 9B shows a state of a connecting pin advancing in the case of a modification, and FIG. 9C shows a state of the advancement being completed.

FIGS. 15A-15C are views showing the rocker arm for high speed, in which FIG. 15A is a side view of the rocker arm for high speed, FIG. 15B is a section taken along line 305-305 of FIG. 15A, and FIG. 15C is a front view.

DETAILED DESCRIPTION OF THE PREFERRED EMBODIMENTS

A "variable valve apparatus", an "engine apparatus" including the variable valve apparatus, and a "two-wheeled motor cycle" which is one example of a transport machines including the engine apparatus, will be described in order hereinafter with reference to the drawings.

Preferred Embodiment 1

A variable valve apparatus according to Preferred Embodiment 1 will be described hereinafter with reference to the drawings. In this specification, the variable valve apparatus will be described taking a DOHC (Double Overhead Cam Shaft) engine for example.

Figure 1:
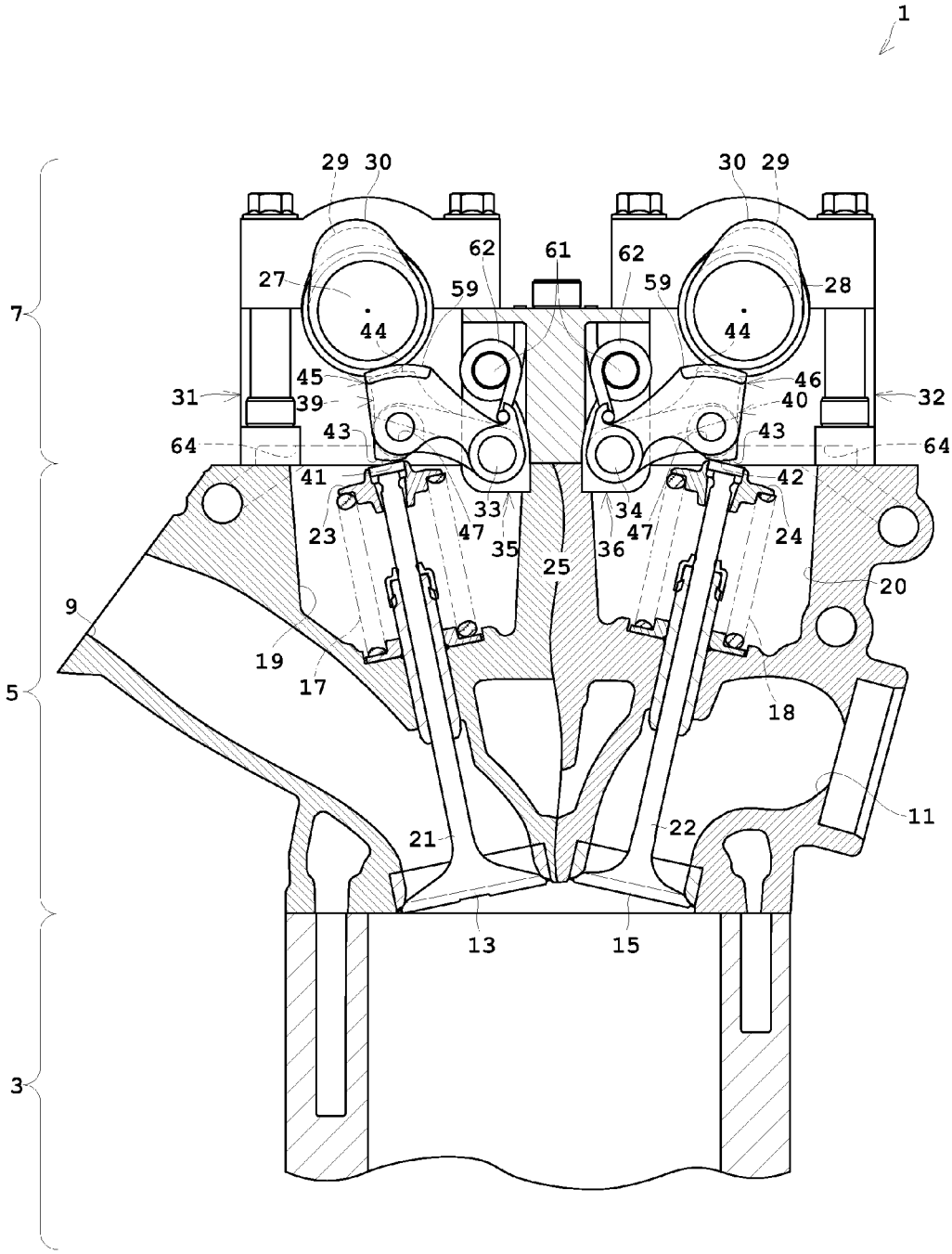
FIG. 1 is a view in vertical section showing an outline construction of an engine having a variable valve apparatus according to a preferred embodiment of the present invention.
Figure 2:
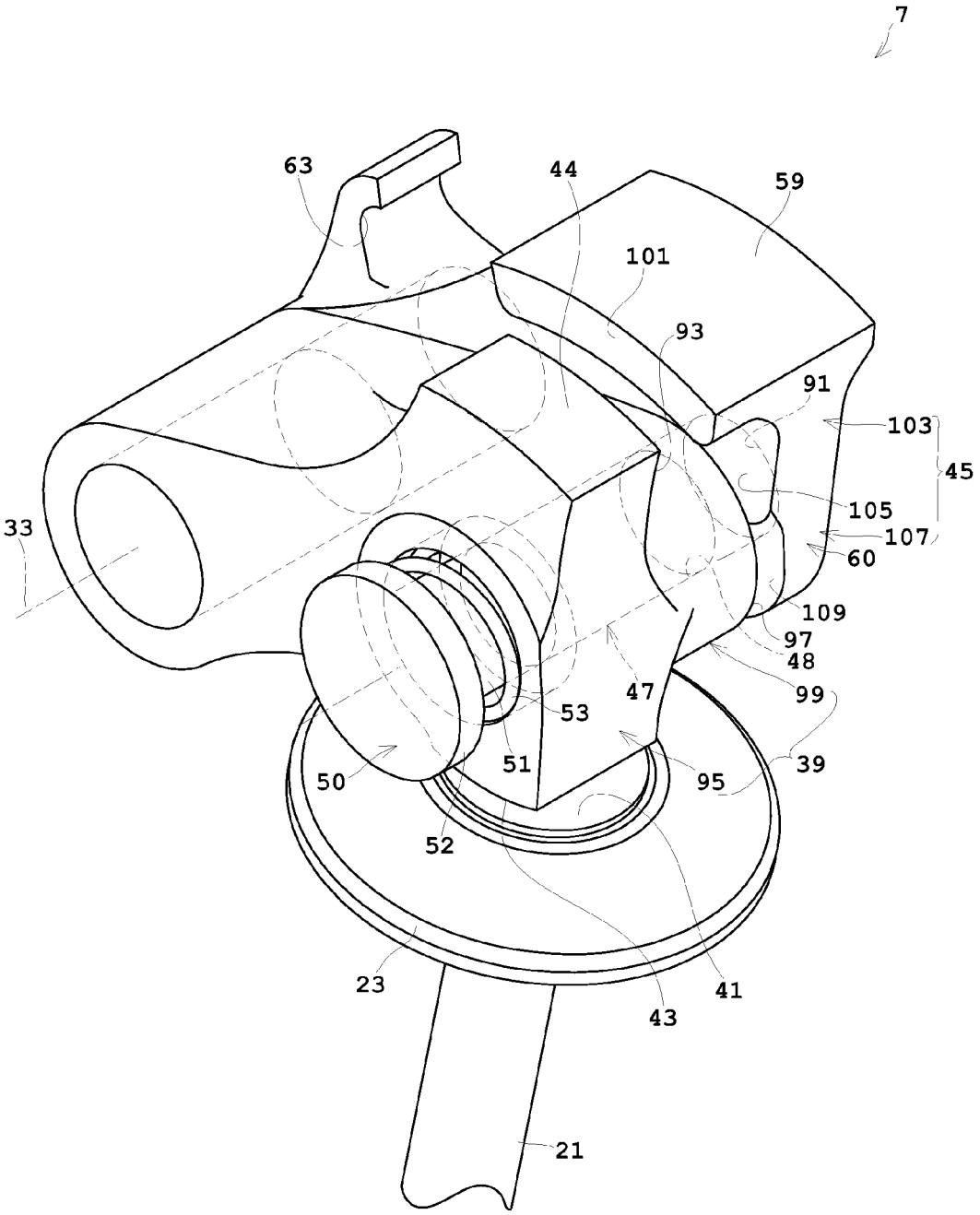
FIG. 2 is a perspective view showing an outward appearance of a rocker arm for low speed and a rocker arm for high speed according to preferred embodiment of the present invention.
Figure 3:
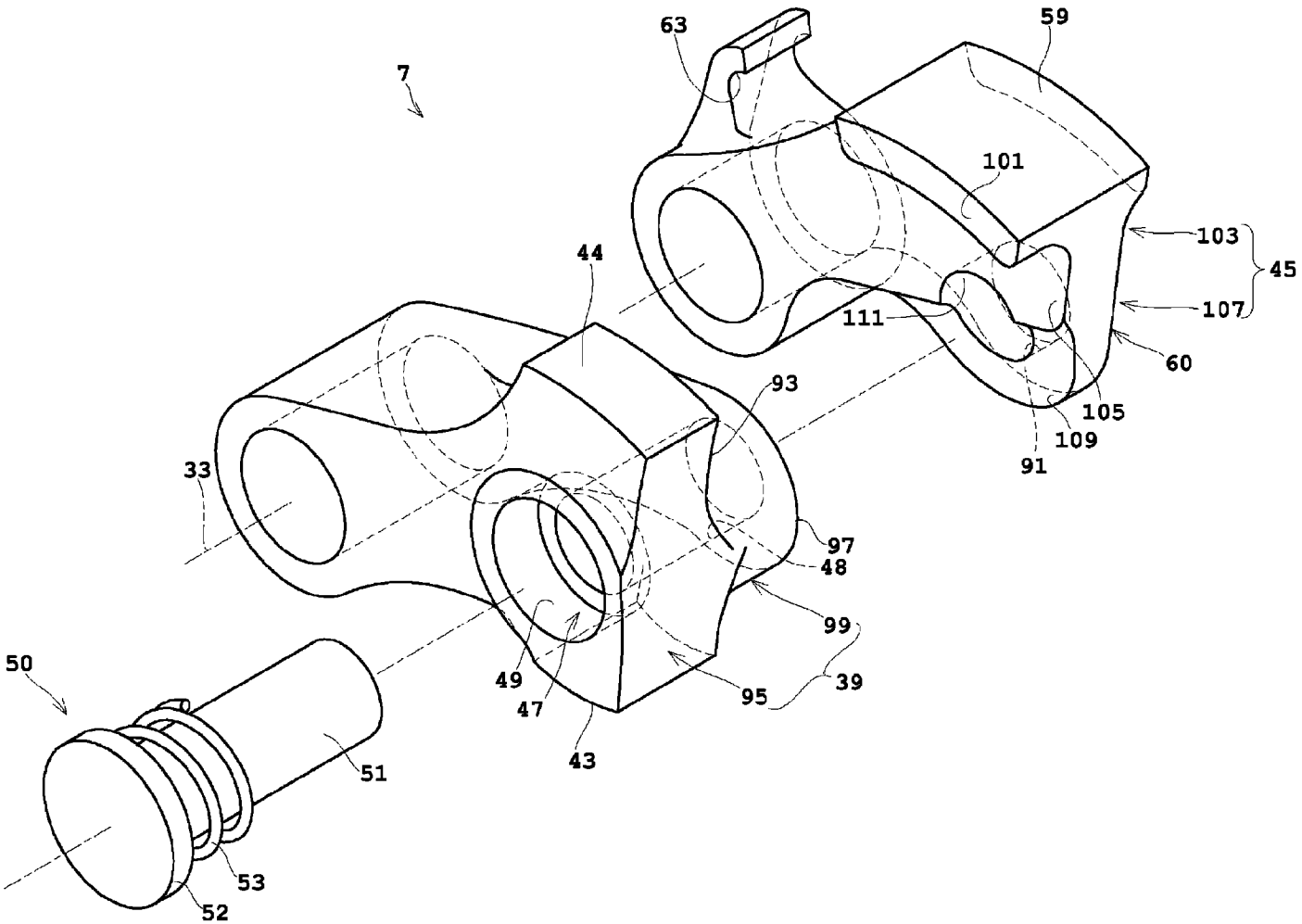
FIG. 3 is an exploded perspective view of the rocker arm for low speed, the rocker arm for high speed and a connecting pin.
Figures 4A, 4B, 4C:
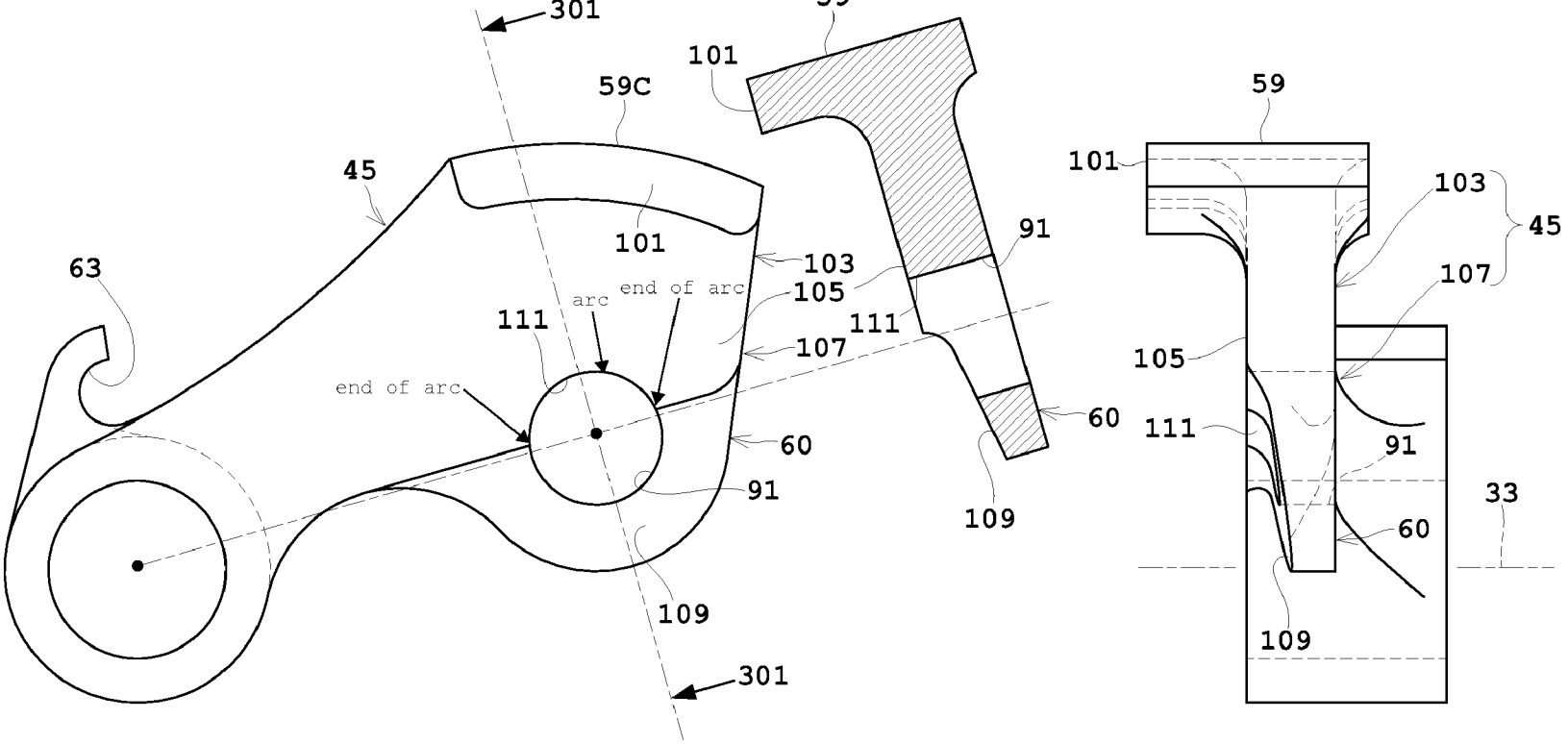
Figure 5B:
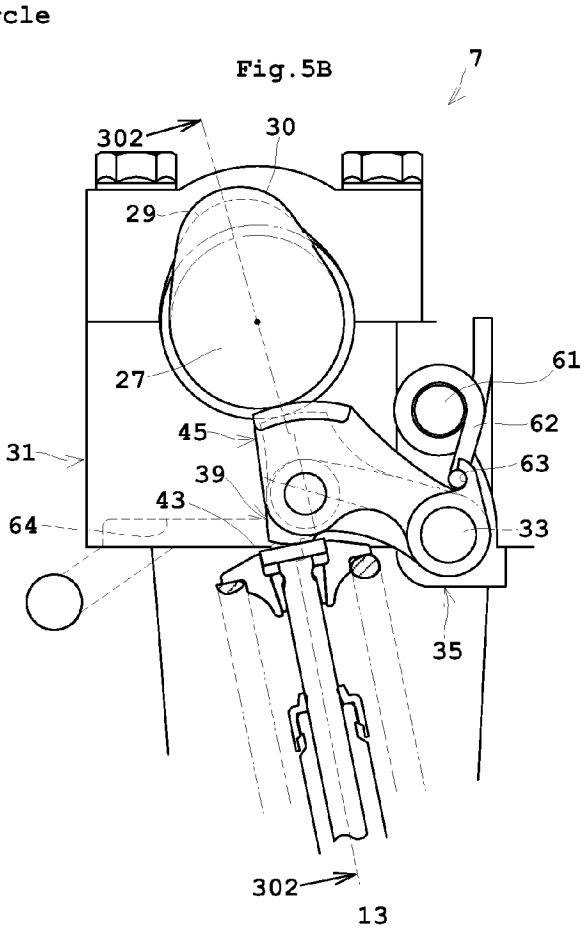
Figure 5A:
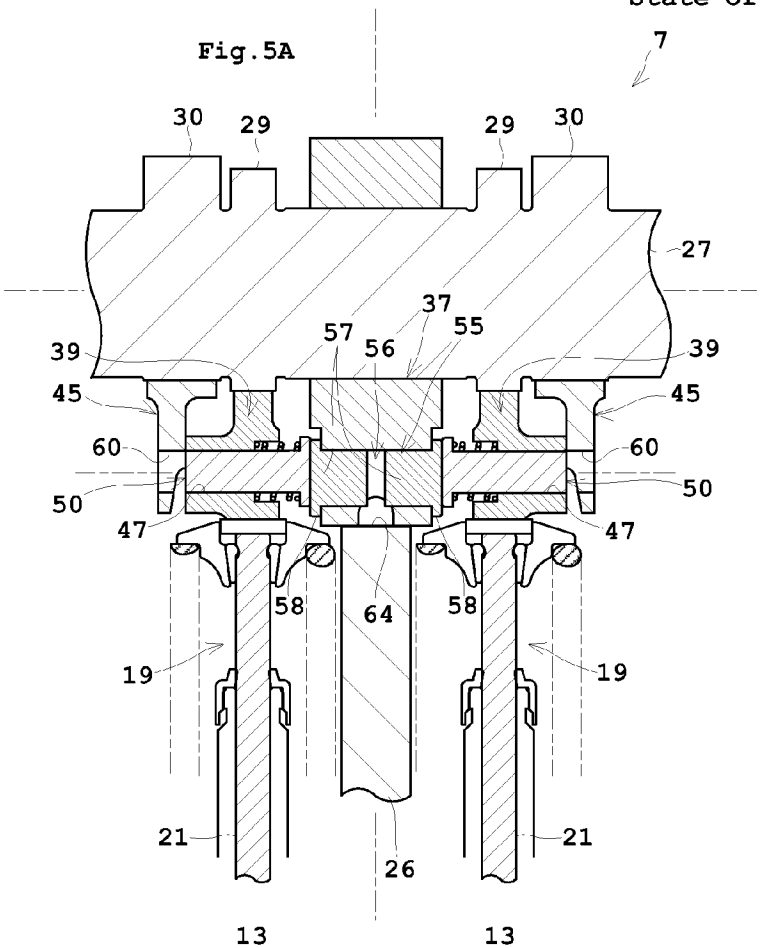
Figure 6A:
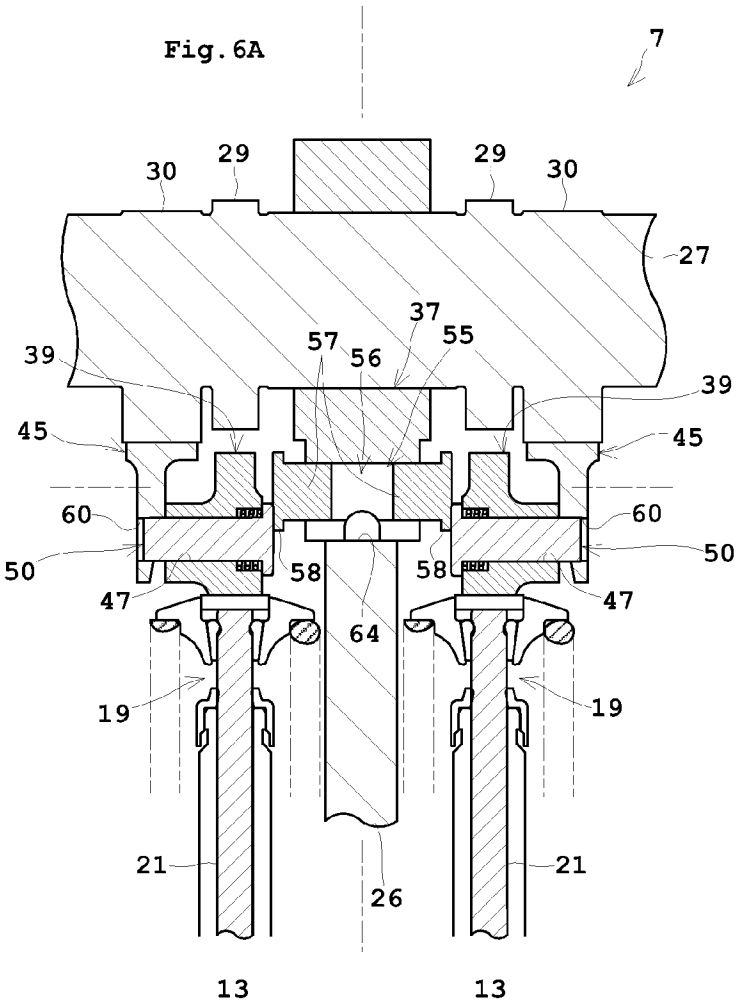
Figure 6B:
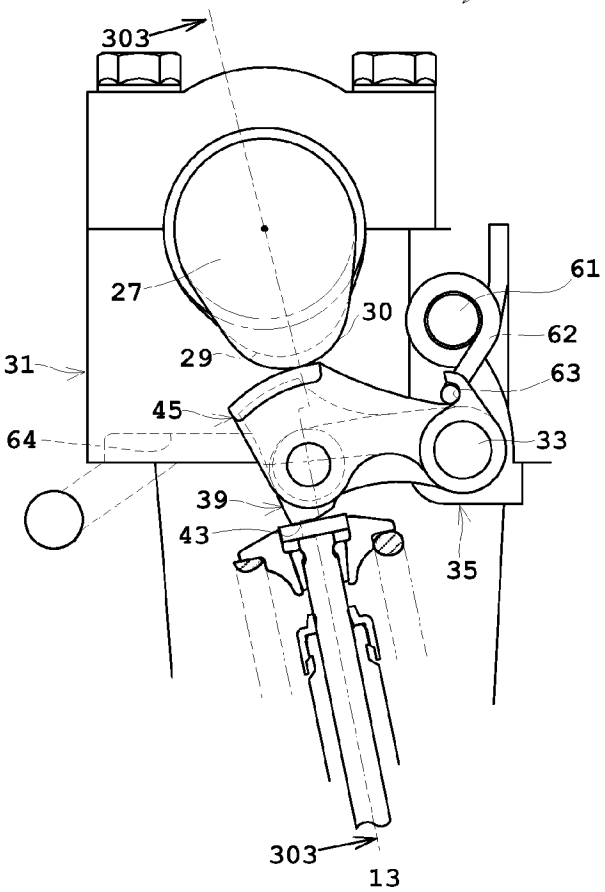
Figure 7B:
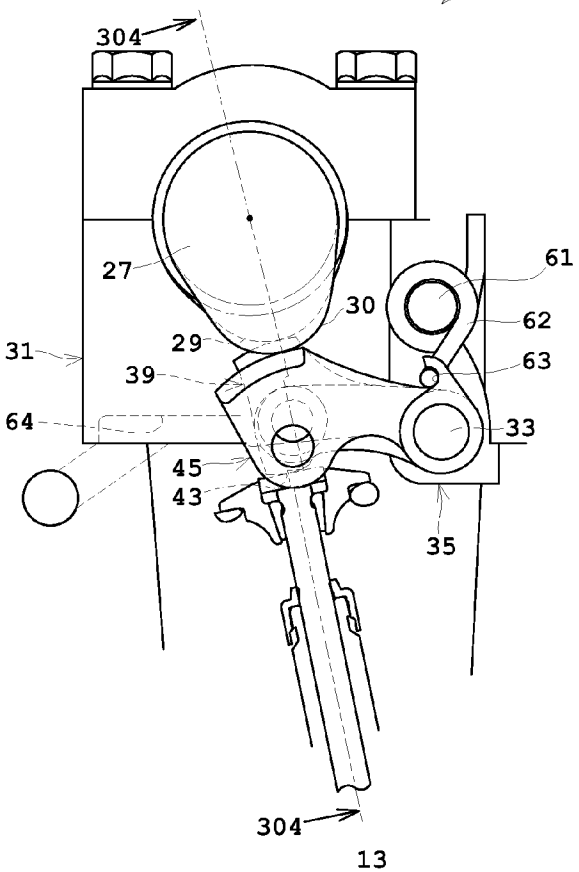
Figure 7A:
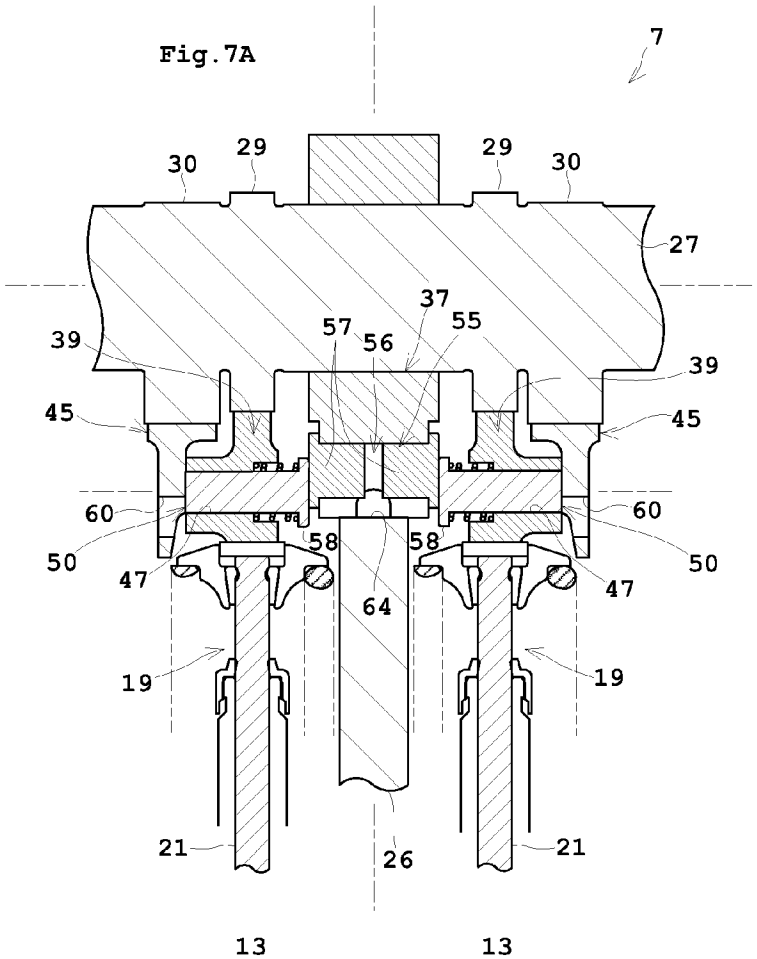

FIG. 1 is a view in vertical section showing an outline construction of an engine including the variable valve apparatus according to Preferred Embodiment 1. FIG. 2 is a perspective view showing an outward appearance of a rocker arm for low speed and a rocker arm for high speed according to Preferred Embodiment 1. FIG. 3 is an exploded perspective view of the rocker arm for low speed, the rocker arm for high speed and a connecting pin. FIGS. 4A-4C are views showing the rocker arm for high speed, in which FIG. 4A is a side view of the rocker arm for high speed, FIG. 4B is a section taken along line 301-301 of FIG. 4A, and FIG. 4C is a front view. FIGS. 5A and 5B are views showing a cam shaft in a state of base circle, in which FIG. 5A is a section taken along line 302-302 of FIG. 5B, and FIG. 5B is a view seen from the axial direction of a rocker arm. FIGS. 6A and 6B are views showing a state of maximum lift amount by cams for high speed, in which FIG. 6A is a section taken along line 303-303 of FIG. 6B, and FIG. 6B is a view seen from the axial direction of a rocker arm. FIGS. 7A and 7B are views showing a state of maximum lift amount by cams for low speed, in which FIG. 7A is a section taken along line 304-304 of FIG. 7B, and FIG. 7B is a view seen from the axial direction of the rocker arm.

An engine 1 includes a cylinder block 3, a cylinder head 5 and a cam carrier 7. The cylinder head 5 is detachably attached to the top of the cylinder block 3. Although not shown, the cam carrier 7 is actually covered by a cam cover. The cylinder block 3 is provided to correspond to the number of cylinders, and four cylinder blocks 3 are arranged for four cylinders, for example. This engine 1 has substantially the same construction for each cylinder, and will be described hereinafter by paying attention to one cylinder.

The cam carrier 7 corresponds to the "variable valve apparatus" according to a preferred embodiment of the present invention.

The cylinder head 5 includes an inlet port 9, an exhaust port 11, an inlet valve 13, an exhaust valve 15, valve springs 17, 18, and valve spring accommodating spaces 19, 20. This engine 1 preferably is the four-valve type, and two each of the inlet valve 13 and exhaust valve 15 are attached. The valve spring 17 is coiled around a valve stem 21 of the inlet valve 13, while the valve spring 18 is coiled around a valve stem 22 of the exhaust valve 15. The valve spring 17 is attached by an upper spring seat 23 attached adjacent a stem end surface (valve stem end) of the valve stem 21. The valve spring 18 is attached by an upper spring seat 24 attached adjacent a stem end surface (valve stem end) of the valve stem 22.

A partition 25 is provided between the valve spring accommodating spaces 19 adjacent the inlet valves 13 and the valve spring accommodating spaces 20 adjacent the exhaust valves 15. As shown in FIG. 5A, a partition 26 is provided also between the valve spring accommodating spaces 19 of two inlet valves 13. Although not shown, a similar partition 26 is provided also between two exhaust valves 15.

Since the construction of the cam carrier 7 is the same at the sides of the inlet valves 13 and exhaust valves 15, the following description will be made taking the side of the inlet valves 13 for example, as appropriate.

As shown in FIG. 1, the cam carrier 7 includes two camshafts 27, 28, and each of the camshafts 27, 28 has, arranged around an axis thereof, cams 29 for low speed with a small amount of displacement and cams 30 for high speed with a large amount of displacement. The cam carrier 7 includes camshaft bearings 31, 32, rocker shaft supports 35, 36 and, as shown in FIG. 5A, a hydraulic cylinder support 37. The hydraulic cylinder support 37 is provided also for the side of the exhaust cylinder 15, but is omitted for expediency of illustration. The cam shaft bearings 31, 32 rotatably support the two cam shafts 27, 28. The rocker shaft supports 35, 36 support rocker shafts 33, 34 such that the rocker shafts 33, 34 are spaced from the cam shafts 27, 28 and substantially parallel to the cam shafts 27, 28. The cam shaft bearings 31, 32, rocker shaft supports 35, 36 and hydraulic cylinder support 37 are preferably constructed integrally. The cam carrier 7 is arranged individually for each cylinder. A four-cylinder engine, for example, has four cam carriers 7 attached thereto.

The rocker shafts 33, 34 include rocker arms 39, 40 for low speed attached to be rockable about the axes thereof. The rocker arms 39, 40 for low speed include valve-side slipper surfaces 43 provided on lower portions adjacent distal end regions thereof to push stem end surfaces (valve stem ends 41, 42) of the valve stems 21, 22, and slipper surfaces 44 provided on upper portions adjacent the distal end regions on which the cams 29 for low speed act. The rocker arm 39 for low speed rocks in response to the cam 29 for low speed of the cam shaft 27, thereby to push the valve stem end 41 directly and operate the inlet valve 13. The rocker arm 40 for low speed rocks in response to the cam 29 for low speed of the cam shaft 28, thereby to push the valve stem end 42 directly and operate the exhaust valve 15.

The rocker shafts 33, 34 include rocker arms 45, 46 for high speed attached to be rockable about the axes thereof. The rocker arms 45, 46 for high speed are attached adjacent the rocker arms 39, 40 for low speed, respectively. Although rockable in response to the cams 30 for high speed, the rocker arms 45, 46 for high speed never push the valve stem ends 41, 42 directly.

The rocker arms 39, 40 for low speed are arranged closer to the cam shaft bearings 31, 32 than are the rocker arms 45, 46 for high speed. The rocker arms 39, 40 for low speed have through-holes 47 formed therein to be substantially parallel to the rocker shafts 33, 34 and to have a circular vertical section. As shown in FIG. 3, this through-hole 47 includes a sliding hole 48 and a receiving hole 49. A connecting pin 50 is slidably inserted in the through-hole 47. The connecting pin 50 includes a shank 51 and a flange 52. The shank 51 is longer than the length of the sliding hole 48, and the flange 52 has a larger diameter than the receiving hole 49. The connecting pin 50 has a compression spring 53 inserted in the shank 51. The shank 51 is inserted in the receiving hole 49 with one end of the compression spring 53 in contact with the flange 52 and the other end in contact with the receiving hole 49. That is, the connecting pin 50 is biased in the through-hole 47 in a withdrawing direction away from the rocker arm 45 for high speed. Therefore, at a normal time, the forward end of the connecting pin 50 is withdrawn in the sliding hole 48, and when the connecting pin 50 is pushed from the side of the flange 52, the forward end of the connecting pin 50 advances from the sliding hole 48 toward the rocker arm 45 for high speed.

As shown in FIGS. 1-3, the through-hole 47 in this Preferred Embodiment 1 is located forward of a rear end of a slipper surface 59 as seen from the axial direction of the rocker shaft 33. Since the through-hole 47 is located in such a position, connecting rigidity can be improved as described hereinafter.

As shown in FIG. 5A, an actuator 55 is disposed in the hydraulic cylinder support 37 opposed to the rocker arms 45 for high speed across the through-holes 47. The actuator 55 includes a hydraulic cylinder 56 and hydraulic pistons 57. The hydraulic pistons 57 include flanges 58 adjacent the rocker arms 39 for low speed. The flanges 58 of the hydraulic pistons 57 are in contact with the flanges 52 of the connecting pins 50 described above.

As shown in FIG. 1, the rocker arms 45 and 46 for high speed include slipper surfaces 59 provided on upper portions adjacent distal end regions on which the cams 30 for high speed act. As shown in FIGS. 2-4, an engaging portion 60 is located below the slipper surface 59. This engaging portion 60 is arranged to correspond to the axis of the through-hole 47 to be capable of engaging the forward end of the connecting pin inserted in the through-hole 47 of the rocker arm 39, 40 for low speed when the forward end advance toward the rocker arm 45, 46 for high speed as described in detail hereinafter.

As shown in FIGS. 1 and 5 B, a lost motion spring shaft 61 is attached to the rocker shaft support 35, 36 in parallel or substantially in parallel with the cam shaft 27. The lost motion spring shaft 61 includes a lost motion spring 62 coiled therearound, with one end hooked on a hook 63 located on a rear portion of the rocker arm 45, 46 for high speed, and the other end hooked on an upper portion of the rocker arm support 35, 36. Therefore, the rocker arm 45, 46 for high speed is biased toward the cam 30 for high speed.

As shown in FIGS. 1 and 5, the cam carrier 7 is attached to the top of the cylinder head 5, and the lower surfaces of the cam shaft bearings 31, 32 are joined to the upper surface of the cylinder head 5. Grooves 64 communicating with the hydraulic cylinder 56 are formed in the lower surfaces of the cam shaft bearings 31, 32. These grooves 64 constitute a control oil line. Therefore, control oil delivered from a hydraulic pump, not shown, flows from the grooves 64 into the hydraulic cylinder 56 through an OCV (Oil Control Valve) not shown. As shown in FIG. 5A, the grooves 64 feed the oil to opposite sides, which presses and advances the hydraulic pistons 57 at opposite sides toward the connecting pins 50.

As seen in FIGS. 2-4, the engaging portion 60 of the rocker arm 45 for high speed includes an engaging hole 91. This engaging hole 91 is preferably cylindrical and has a long axis in the longitudinal direction extending axially of the rocker shaft 33.

The rocker arm 39 for low speed includes a first cam receiver 95 including a first side surface 93 arranged in a direction depending from an end of the slipper surface 44. The rocker arm 39 for low speed includes also a first connector 99 that is integral with the first cam receiver 95, including a second side surface 97 with a larger width than the first cam receiver 95 and projecting further toward the rocker arm 45 for high speed than the first side surface 93, and defining the sliding hole 48 of the through-hole 47. The second side surface 97 may be provided only closer to the inlet valve 13 than is the first side surface 93, and need not necessarily be wider than the first cam receiver 95 or project further than the first side surface 93.

The rocker arm 45 for high speed includes a second cam receiver 103 including a third side surface 101 arranged in a direction depending from an end of the slipper surface 59. The rocker arm 45 for high speed includes also a second connector 107 that is integral with the second cam receiver 103, including a fourth side surface 105 opposed to the second side surface 97 of the first connector 99, and defining the engaging portion 60 (engaging hole 91).

As shown in FIGS. 4B and 4C, the second connector 107 includes a fifth side surface 109 located below the fourth side surface 105 and further away from the second side surface 97 than the fourth side surface 105, so that the width in the direction along the rocker shaft 33 is narrower in a lower portion adjacent the inlet valve 13 than in an upper portion adjacent the slipper surface 59. A guide surface 111 is located in a lower portion of the fourth side surface 105 and includes an arc that is shorter than a semicircle, and coaxial and equal in radius with the engaging hole 91. In other words, the second connector 107 is tapered to have a downwardly converging vertical section.

Since the cam carrier 7 includes the second connector 107 including the cylindrical engaging hole 91 as described above, it is not only easily manufactured but can improve manufacturing accuracy, compared with the case of being semicircular or arcuate.

With the engine 1 having the above construction, the inlet valves 13 are operated as follows. Although description is omitted, the same applies also to the exhaust valves 15.

As shown in FIGS. 6A and 6B, the hydraulic pressure in the groove 64 is increased by opening the OCV provided on the control oil line at a time of high speed. Therefore, the hydraulic pistons 57 are advanced toward the connecting pins 50, the connecting pins 50 are pushed into the through-holes 47, and the forward ends of the shanks 51 jump out of the through-holes 47 toward the rocker arms 45 for high speed. Since the rocker arms 45 for high speed are biased by the lost motion springs 62 toward the cams 30 for high speed, the engaging portions 60 are meshed with the shanks 51 of the connecting pins 50. As a result, the rocker arms 39 for low speed and rocker arms 45 for high speed are connected. When the rocker arms 45 for high speed are rocked to a large extent by the cams 30 for high speed with a large amount of displacement, the rocker arms 39 for low speed will also be rocked together to a large extent. Through this series of operations, the rocker arms 39 for low speed push the valve stem ends 41 to lift the inlet valves 13 to a large extent.

As noted hereinbefore, the through-holes 47 of the rocker arms 39 for low speed are located forward of the rear ends of the slipper surfaces 59 of the rocker arms 45 for high speed. Thus, even in a state of maximum lift by the cams 30 for high speed, there occurs little deflection at the distal ends of the rocker arms 45 for high speed, with the connecting pins 50 acting as shafts. Similarly, little deflection occurs at the distal ends of the rocker arms 39 for low speed when pushed back by the inlet valves 13. Therefore, since connecting rigidity of the rocker arms 39 for low speed and the rocker arms for high speed can be improved, a disagreement between the profile of the cams 30 for high speed and the lift profile of the inlet valves 13 and exhaust valves 15 can be reduced to acquire a desired operating state.

As seen in FIGS. 7A and 7B, at a time of low speed, the hydraulic pressure in the groove 64 is lowered by closing the OCV provided on the control oil line at a time of low speed. Therefore, the hydraulic pistons 57 are pushed back into the hydraulic cylinder 56 by the connecting pins 50 biased by the compression springs 53, and the shanks 51 of the connecting pins 50 are withdrawn into the through-holes 47. As a result, the rocker arms 39 for low speed and the rocker arms 45 for high speed are separated. When the rocker arms 39 for low speed are rocked to a small extent by the cams 29 for low speed with a small amount of displacement, the rocker arms 39 for low speed will push the valve stem ends 41 directly, and lift the inlet valves 13 to a small extent. Although the rocker arms 45 for high speed are rocked to a large extent by the cams 30 for high speed at this time, since the connecting pins 50 are out of engagement, the rocker arms 45 for high speed exert no action on the valve stem ends 41. That is, the rocker arms 45 for high speed perform only "idle rocking".

Figure 8:
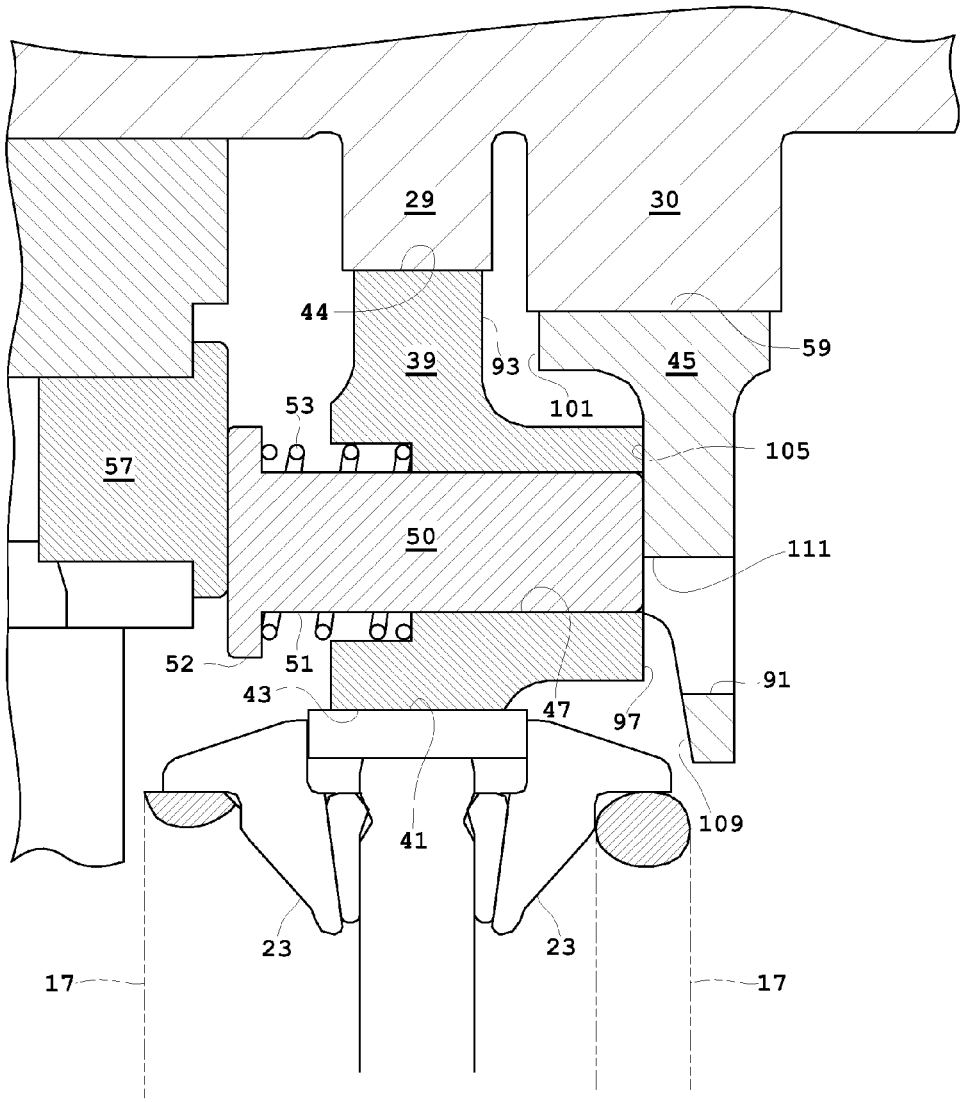
FIG. 8 is a view in vertical section showing a state where the rocker arm for high speed is experiencing idle rocking.

Reference is now made to FIG. 8. FIG. 8 is a view in vertical section showing a state where the rocker arm for high speed is experiencing "idle rocking".

The second connector 107 includes the fifth side surface 109 that is narrower in a lower portion than in a lower portion adjacent the valve 13 than in an upper portion adjacent the slipper surface 59. Thus, there is no possibility of the rocker arm 45 for high speed, at a time of idle rocking, interfering with the upper spring seat 23 or valve spring 17. Therefore, the rocker arm 45 for high speed can be rocked to a large extent at the time of idle rocking, which allows an increased design freedom for the cam 30 for high speed.

Figure 9A:
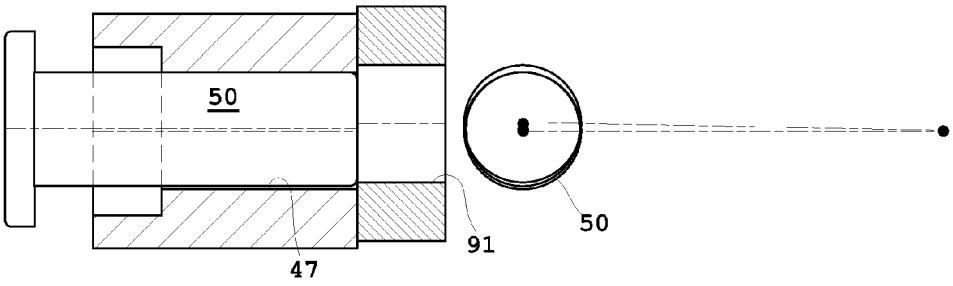
Figure 9B:
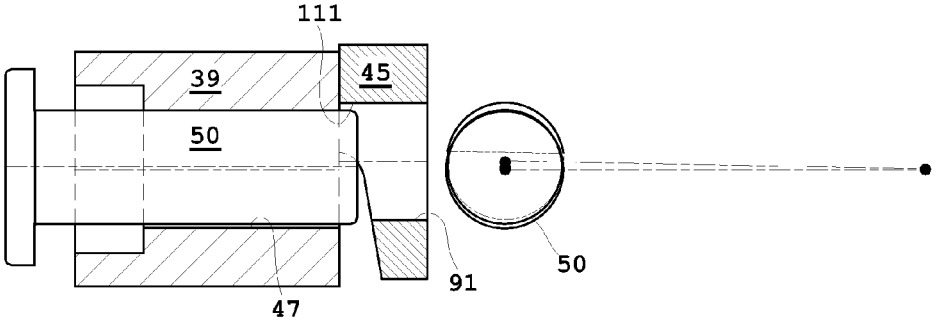
Figure 9C:
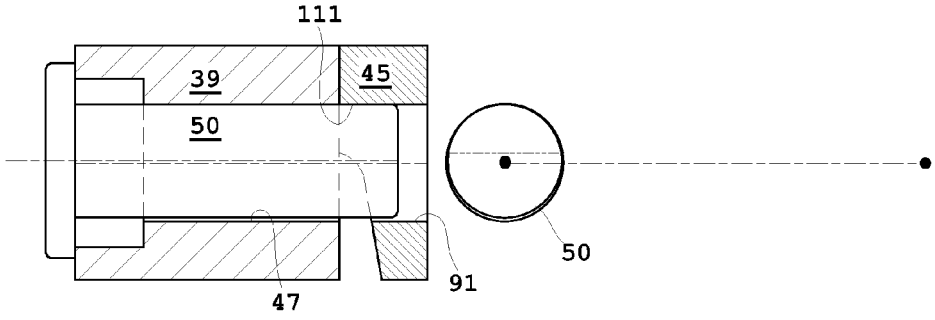

An advantage of the engaging hole 91 will be described with reference to FIGS. 9A-9C. FIGS. 9A-9C are schematic views illustrating an advantage where the engaging bore is cylindrical, in which FIG. 9A shows a case of being simply cylindrical, FIG. 9B shows a state of the connecting pin advancing in the case of a modification, and FIG. 9C shows a state of the advancement being completed.

Where the engaging hole 91 is simply cylindrical as shown in FIG. 9A, the connecting pin 50 cannot advance into the engaging whole 91 unless the through-hole 47 and engaging hole 91 are in precise alignment. While the rocker arm 45 for high speed is biased by the lost motion spring 62 toward the cam 30 for high speed, a tappet clearance exists between the rocker arm 39 for low speed and the valve stem end 41 or the cam 29 for low speed, and therefore a misalignment corresponding to the tappet clearance can occur between the through-hole 47 and engaging hole 91. Therefore, the timing of the through-hole 47 and engaging hole 91 coming into precise alignment to be engageable will become short. However, the guide surface 111 is located in a lower portion of the fourth side surface 105 and includes an arc shorter than a semicircle. Thus, even when the connecting pin 50 is advanced in a state of the through-hole 47 and engaging hole 91 not being in precise alignment as shown in FIGS. 9B and 9C, the forward end of the connecting pin 50 is guided through the guide surface 111 into the engaging hole 91. An extended period can therefore be secured for advancing the connecting pin 50, to improve the certainty of connection.

Figure 10:
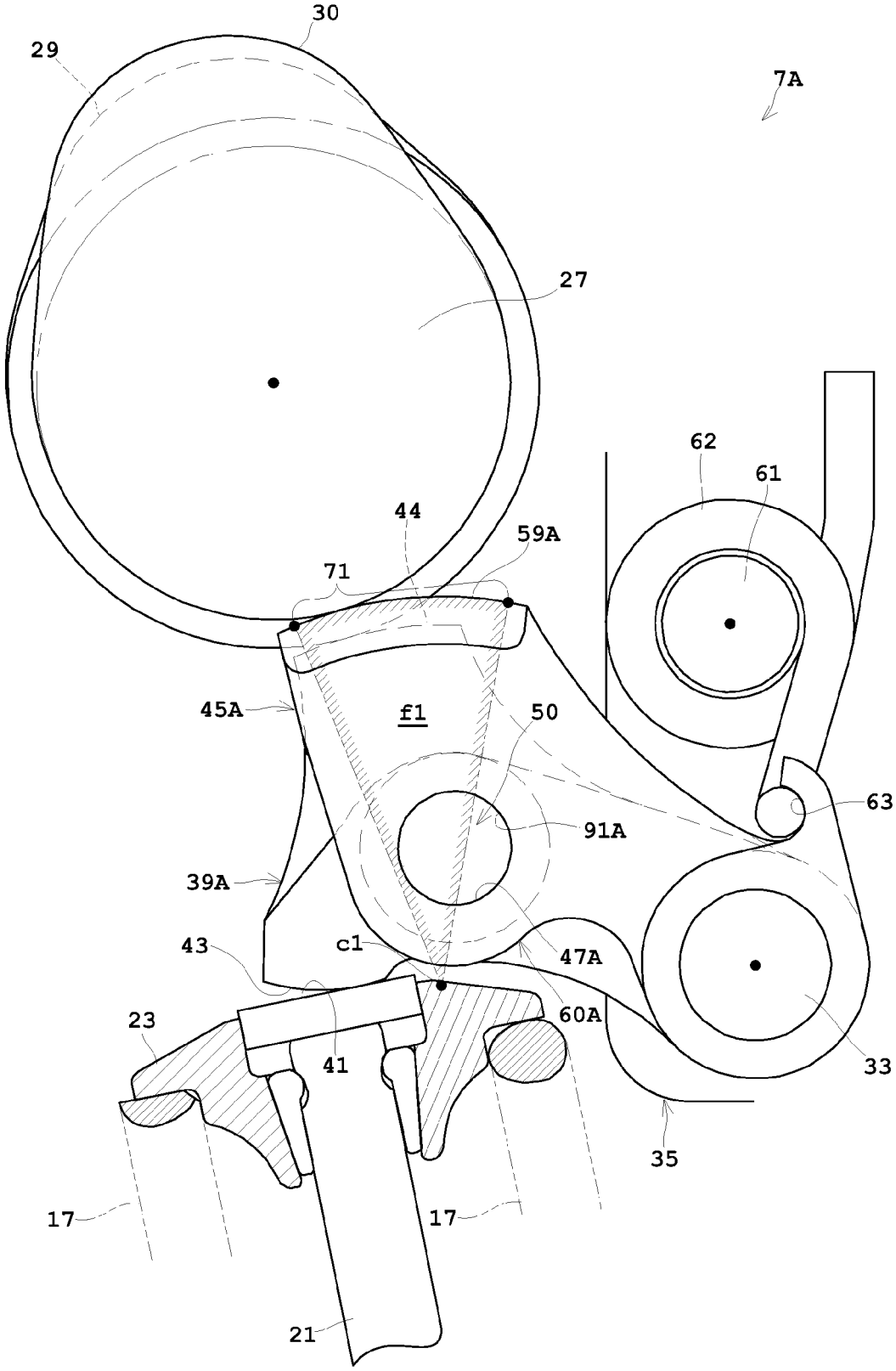
FIG. 10 is a view showing desirable example 1 of positional relationship of a through-hole.
Figure 11:
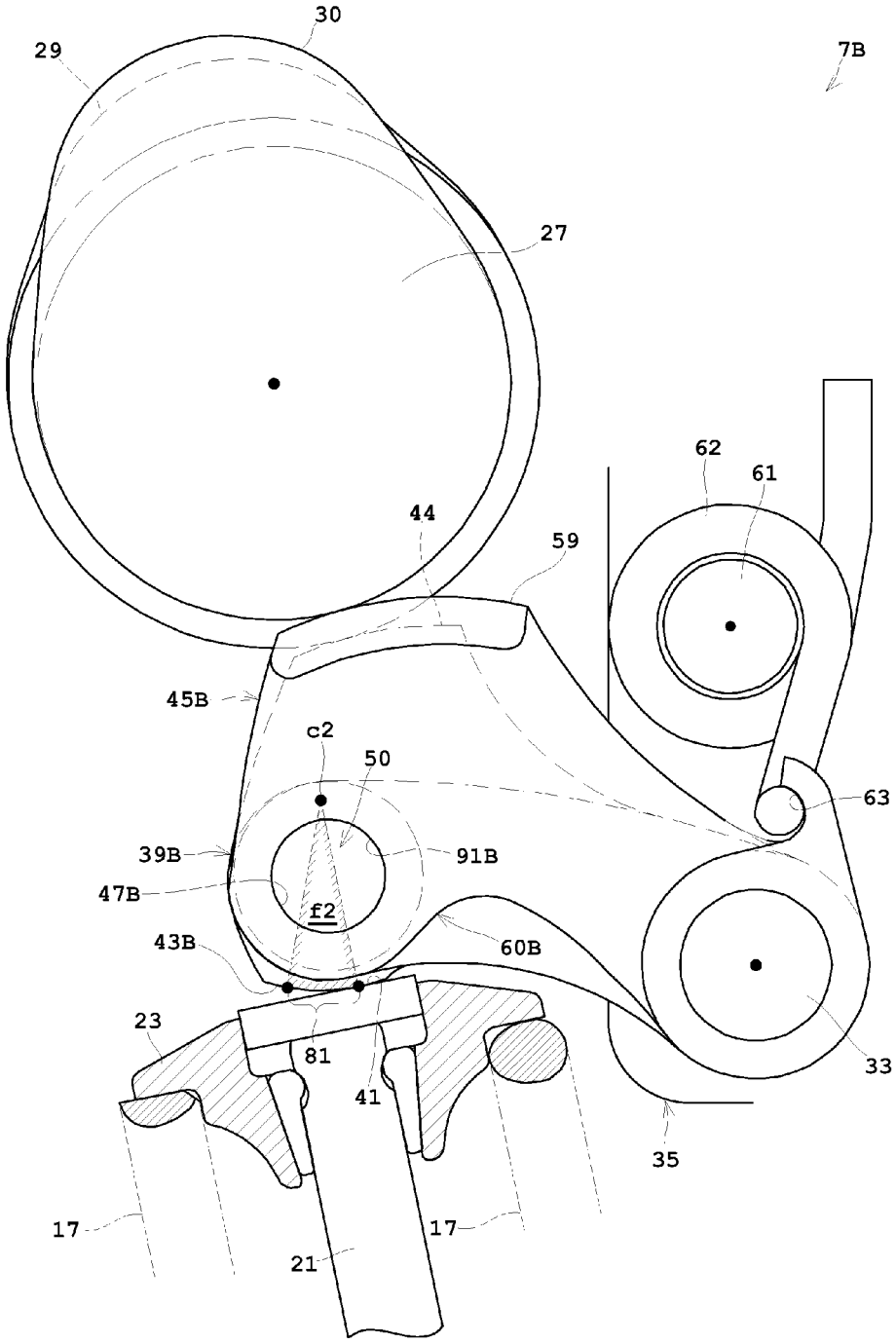
FIG. 11 is a view showing desirable example 2 of positional relationship of the through-hole.
Figure 12:
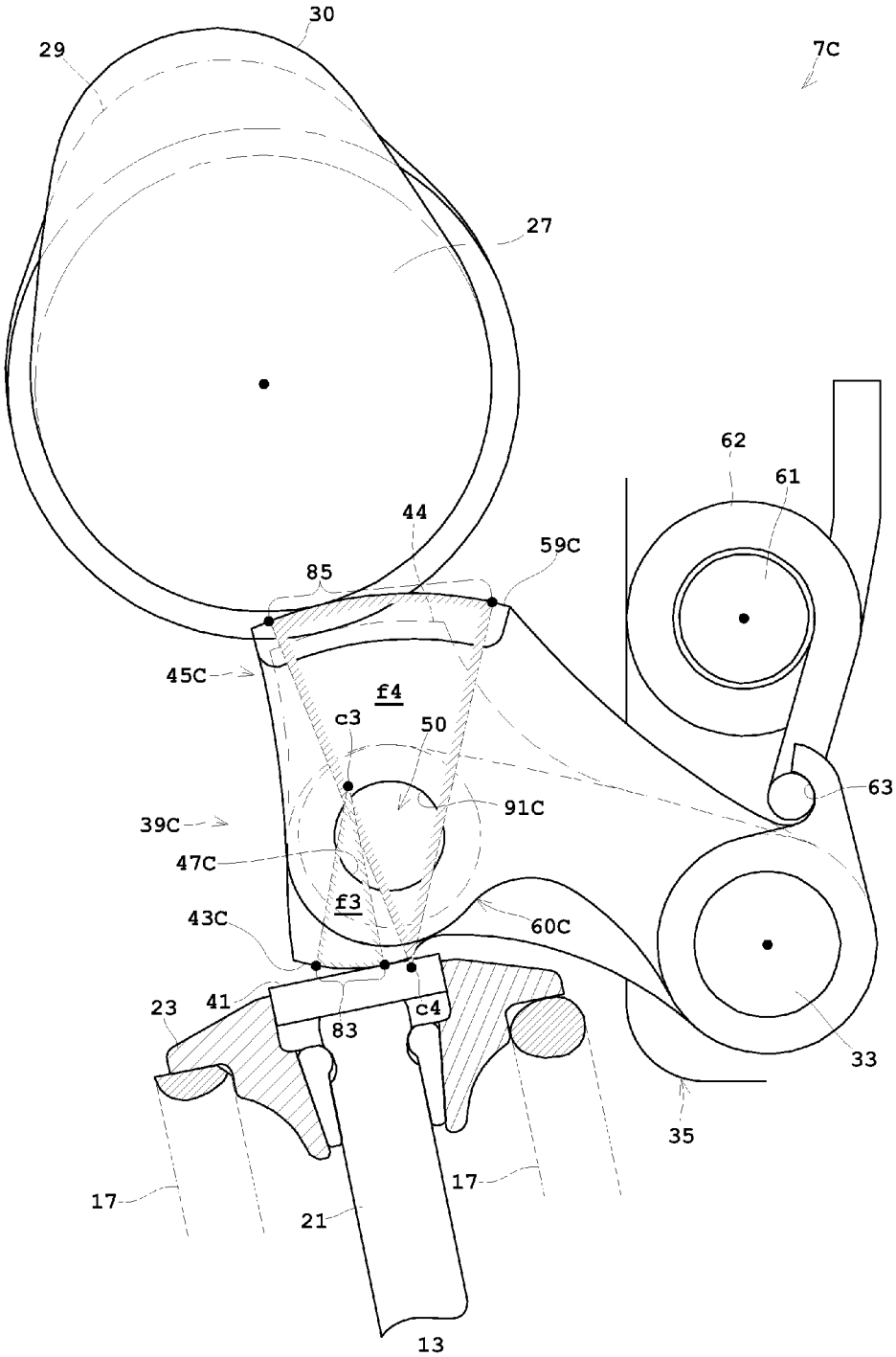
FIG. 12 is a view showing desirable example 3 of positional relationship of the through-hole.

Next, desirable positions for forming the above through-hole 47 and engaging hole 91 in the cam carrier 7 will be described with reference to FIGS. 10-12. FIG. 10 is a view showing desirable example 1 of positional relationship of the through-hole. FIG. 11 is a view showing desirable example 2 of positional relationship of the through-hole. FIG. 12 is a view showing desirable example 3 of positional relationship of the through-hole.

As shown in FIG. 10, which shows a first example of a positional relationship, the cam carrier 7A includes a rocker arm 39A for low speed and a rocker arm 45A for high speed. Further, it is desirable that a through-hole 47A formed in the rocker arm 39A for low speed and an engaging hole 91A formed in the rocker arm 45A for high speed are arranged to have the following positional relationship.

That is, as seen from the axial direction of the rocker shaft 33, it is formed in a position to have at least a portion thereof located within the range of a sector f1 defined by an arcuate portion 71, on which the cam 30 for high speed slides, of a slipper surface 59A of the rocker arm 45A for high speed, and the center c1 of a circle providing the arc of the slipper surface 59A of the rocker arm 45A for high speed. In other words, the connecting pin 50 is mounted in a position where a portion thereof is located within the range of the above sector f1.

As long as it is a position where portions of the through-hole 47A and engaging hole 91A are located in the sector f1, it may be other than the position shown in FIG. 10.

According to the construction with such example 1 of positional relationship, the distance from the connecting pin 50 to the point of contact with the cam 30 for high speed in a direction perpendicular or substantially perpendicular to the axis can be shortened as compared with the prior art, and the amount of deflection of the rocker arm 45A for high speed occurring from the connecting pin 50 to the forward end region of the rocker arm 45A for high speed can be reduced. As a result, since connecting rigidity in an engaging portion 60A can be improved, a disagreement between the profile of the cam 30 for high speed and the lift profile of the inlet valve 13 and exhaust valve 15 can be reduced to acquire a desired operating state.

As shown in FIG. 11, which shows a second example of a positional relationship, the cam carrier 7B includes a rocker arm 39B for low speed and a rocker arm 45B for high speed. Further, it is desirable that a through-hole 47B formed in the rocker arm 39B for low speed and an engaging hole 91B formed in the rocker arm 45B for high speed have the following positional relationship.

That is, as seen from the axial direction of the rocker shaft 33, it is formed in a position to have at least a portion thereof located within the range of a sector f2 defined by an arcuate portion 81, on which the valve stem end 41 of the inlet valve 13 slides, of a valve-side slipper surface 43B of the rocker arm 39B for low speed, and the center c2 of a circle providing the arc of the arcuate portion 81. In other words, the connecting pin 50 is mounted in a position where a portion thereof is located within the range of the above sector f2. In accordance with this position, an engaging portion 60B of the rocker arm 45B for high speed is provided.

According to the construction of example 2 of the positional relationship, the distance from the connecting pin 50 to the point of contact with the valve stem end 41 in a direction perpendicular or substantially perpendicular to the axis can be shortened as compared with the prior art, and the amount of deflection occurring from the connecting pin 50 to the forward end region of the rocker arm 39B for low speed can be reduced. As a result, since connecting rigidity in the engaging portion 60B can be improved, a disagreement between the profile of the cam 30 for high speed and the lift profile of the inlet valve 13 and exhaust valve 15 can be reduced to acquire a desired operating state.

As long as it is a position where portions of the through-hole 47B and engaging hole 91B are located in the sector f2, it may be other than the position shown in FIG. 11.

As shown in FIG. 12, which shows a third example of a positional relationship, the cam carrier 7C includes a rocker arm 39C for low speed and a rocker arm 45C for high speed. Further, it is desirable that a through-hole 47C formed in the rocker arm 39C for low speed and an engaging hole 91C formed in the rocker arm 45C for high speed have the following positional relationship.

That is, as seen from the axial direction of the rocker shaft 33, it is arranged in a position to have at least a portion thereof located within the range of a sector f3 defined by an arcuate portion 83, on which the valve stem end 41 of the inlet valve 13 slides, of a valve-side slipper surface 43C of the rocker arm 39C for low speed, and the center c3 of a circle providing the arc of the arcuate portion 83. In other words, the connecting pin 50 is disposed in a position where a portion thereof is located within the range of the above sector f3.

Further, as seen from the axial direction of the rocker shaft 33, the through-hole 47C is formed in a position to have at least a portion thereof located within the range of a sector f4 defined by an arcuate portion 85, on which the cam 30 for high speed slides, of a slipper surface 59C of the rocker arm 45C for high speed, and the center c4 of a circle providing the arc of the slipper surface 59C of the rocker arm 45C for high speed. In other words, the connecting pin 50 is disposed in a position where a portion thereof is located within the ranges of the above sectors f3 and f4.

According to the construction with such example 3 of positional relationship, since the through-hole 47C is formed in the sector f3, the direction of the force applied from the point of contact with the valve stem end 41 is turned toward the connecting pin 50. The point of contact at which the cam 30 for high speed acts on the slipper surface 59C of the rocker arm 45C for high speed moves. However, since the through-hole 47C is formed in the sector f4, the direction of the force applied from the point of contact with the cam 30 for high speed will be turned toward the connecting pin 50. Therefore, the distance from the connecting pin 50 to the point of contact with the cam 30 for high speed in a direction perpendicular or substantially perpendicular to the axis can be shortened as compared with the prior art. As a result, the amount of deflection occurring from the connecting pin 50 to the forward end region of the rocker arm 39C for low speed can be reduced, and the amount of deflection of the rocker arm 45C for high speed occurring from the connecting pin 50 to the forward end region of the rocker arm 45C for high speed can be reduced. As a result, since connecting rigidity in the engaging portion 60C can be further improved, a disagreement between the profile of the cam 30 for high speed and the lift profile of the inlet valve 13 and exhaust valve 15 can be further reduced to acquire a desired operating state.

As long as it is a position where portions of the through-hole 47C and engaging hole 47C are located in the sector f3 and sector f4, it may be other than the position shown in FIG. 12.

Preferred Embodiment 2

Next, Preferred Embodiment 2 of the present invention will be described with reference to the drawings. While components duplicating those of foregoing Preferred Embodiment 1 are shown with the same reference signs, and will not particularly be described, only principal components different from foregoing Preferred Embodiment 1 will be described in detail.

Figure 13:
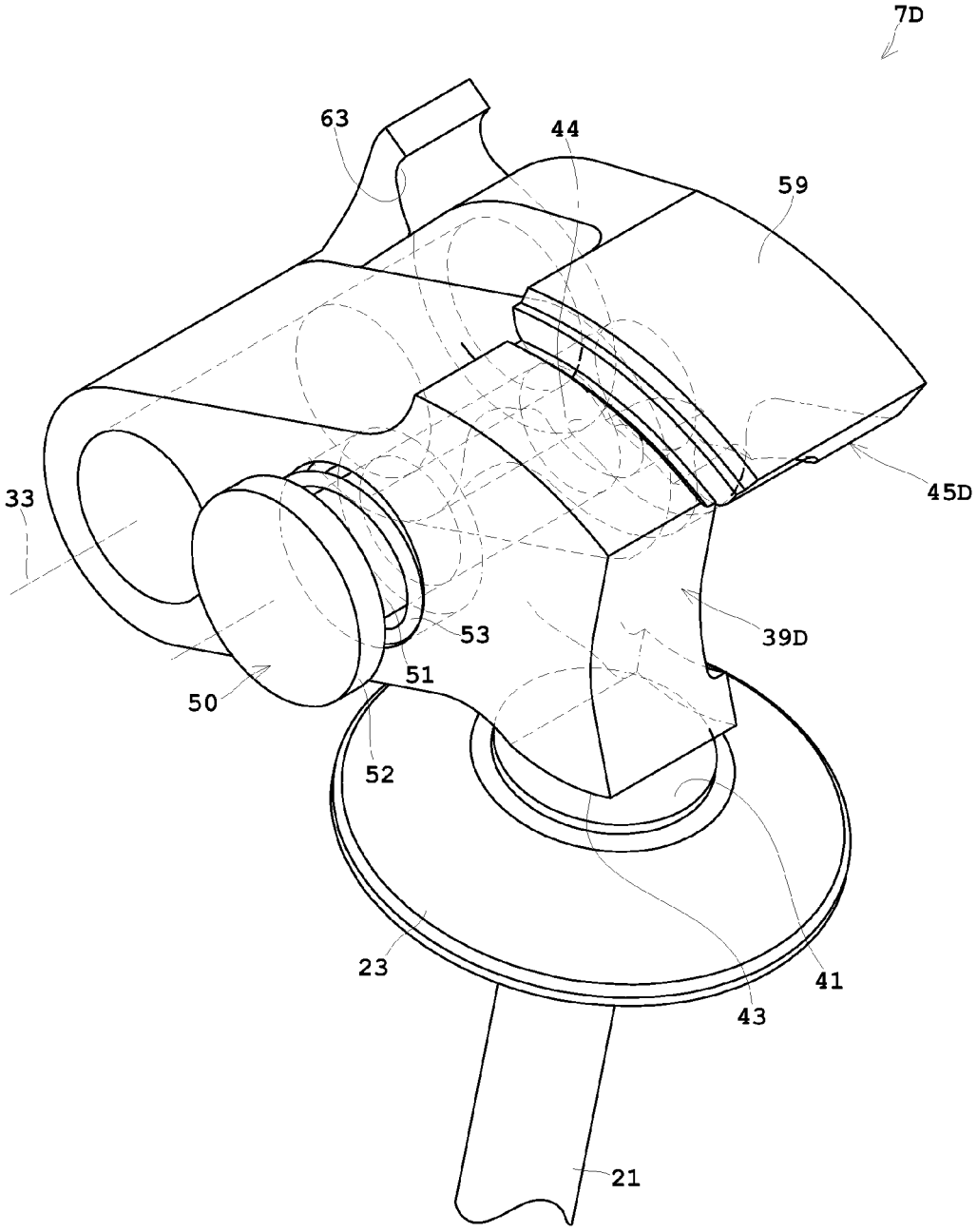
FIG. 13 is a perspective view showing an outward appearance of a rocker arm for low speed and a rocker arm for high speed according to another preferred embodiment of the present invention.
Figure 14:
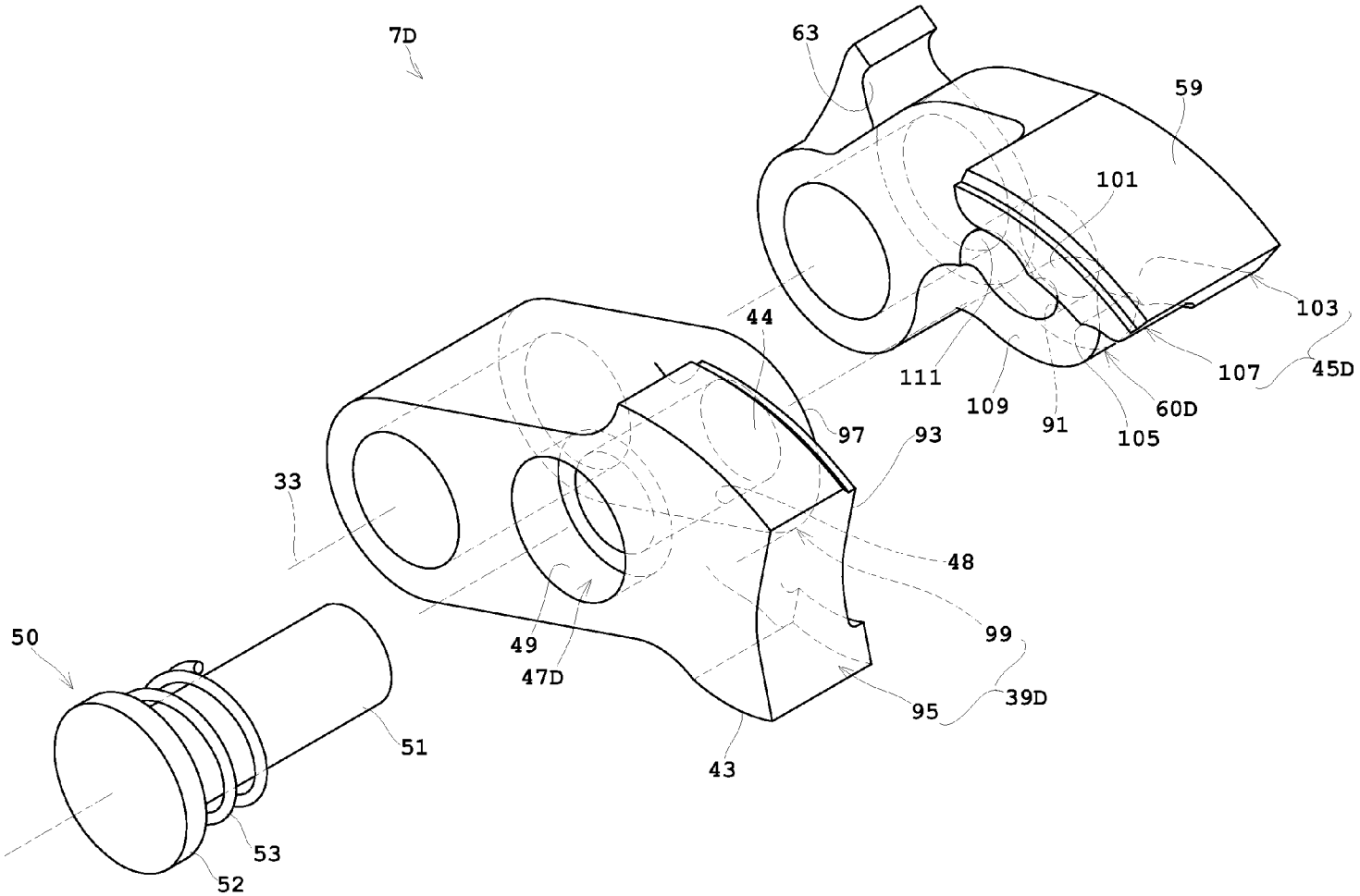
FIG. 14 is an exploded perspective view of a rocker arm for low speed, a rocker arm for high speed and a connecting pin.
Figures 15A, 15B, 15C:
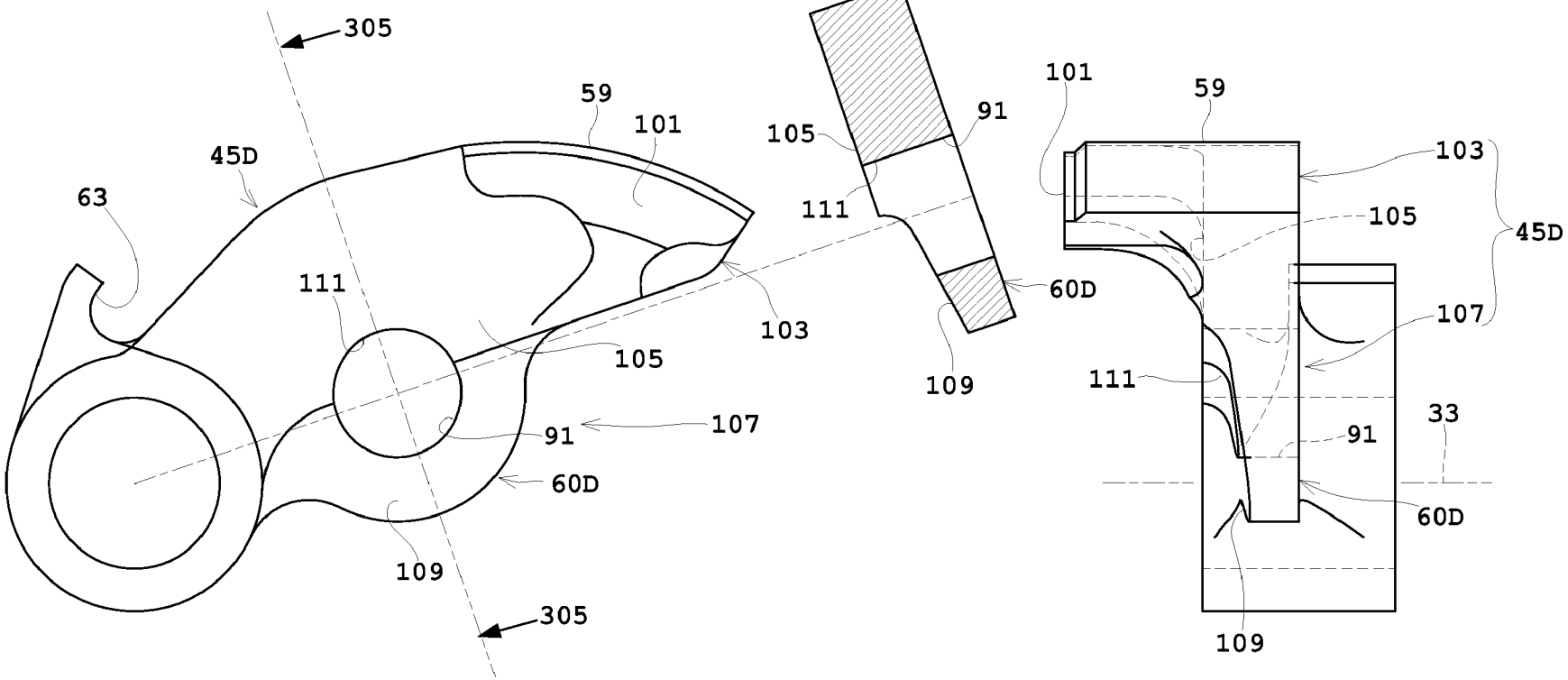

Reference is made to FIGS. 13-15C. FIG. 13 is a perspective view showing an outward appearance of a rocker arm for low speed and a rocker arm for high speed according to Preferred Embodiment 2. FIG. 14 is an exploded perspective view of the rocker arm for low speed, the rocker arm for high speed and a connecting pin. FIGS. 15A-15C are views showing the rocker arm for high speed, in which FIG. 15A is a side view of the rocker arm for high speed, FIG. 15B is a section taken along line 305-305 of FIG. 15A, and FIG. 15C is a front view.

A cam carrier 7D in this Preferred Embodiment 2 includes a rocker arm 39D for low speed and a rocker arm 45D for high speed. In this Preferred Embodiment 2, a through-hole 47D of the rocker arm 39D for low speed is formed in a position different from foregoing Preferred Embodiment 1. Specifically, as seen from the rocker shaft 33, the through-hole 47D is provided in a position between a rear end portion of the slipper surface 59 of the rocker arm 45D for high-speed and the rocker shaft 33. An engaging portion 60D, fifth side surface 109 and guide surface 111 are formed as in Preferred Embodiment 1, and their positions are, as seen from the rocker shaft 33, between the rear end portion of the slipper surface 59 of the rocker arm 45 for high speed and the rocker shaft 33.

According to this Preferred Embodiment 2, the same effects among the effects of foregoing Preferred Embodiment 1 can be produced, except the improvement in connecting rigidity.

The present invention is not limited to the configurations of the rocker arms 45, 45A-45D, 46 for high speed and the rocker arms 39, 39A-39D, 40 for low speed in foregoing Preferred Embodiments 1 and 2. That is, the same effects can be produced if the engaging portion 60 includes the cylindrical engaging hole 91, and includes the guide surface 111 provided on the rocker arm 39, 39A-39D, 40 for low speed and having an arc shorter than a semicircle.

Figure 16:
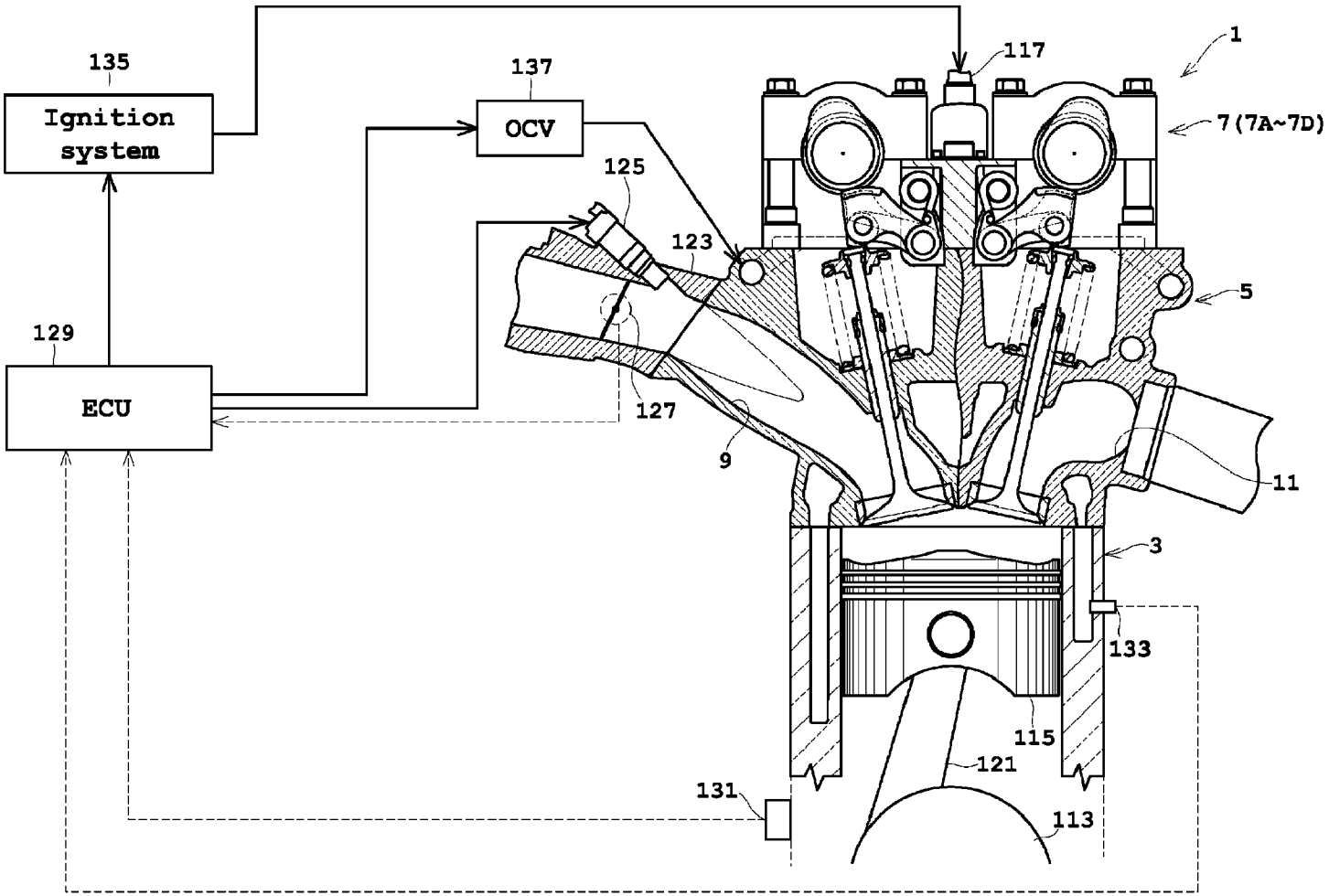
FIG. 16 is a view showing an outline construction of an engine apparatus according to a preferred embodiment of the present invention.

An example of engine apparatus having the above cam carrier 7 (7A-7D) will be described with reference to FIG. 16. FIG. 16 is a view showing an outline construction of an engine apparatus according to a preferred embodiment of the present invention.

An engine 1 of this engine apparatus includes cylinder blocks 3, the above cylinder head 5, one of the above cam carriers 7 and 7A-7D, a crankshaft 113, pistons 115 and spark plugs 117.

The piston 115 in the cylinder block 3 is connected to the crankshaft 113 by a connecting rod 121. A fuel injector 125 is attached to an inlet pipe 123 communicating with an inlet port 9. A grip or the like (not shown) includes, disposed thereon, an accelerator sensor 127 which outputs signals corresponding to accelerator manipulated variables. The signals from this accelerator sensor 127 are taken into an ECU 129, and the fuel injector 125 is operated by ECU 129 in response to the signals.

The cylinder block 3 includes a rotary encoder 131 attached thereto to detect a rotation angle of the crankshaft 113. Further, the cylinder block 3 includes a water temperature sensor 133 arranged to measure a temperature of engine cooling water. A rotation angle (crank angle) of the crankshaft 113 is detected from an output signal of the rotary encoder 131, and a temperature of the engine 1 is detected from an output signal of the water temperature sensor 133. Based on these, the ECU 129 can determine operating conditions (operational states) of the engine 1.

The ECU 129 controls an ignition system 135 in accordance with the operating conditions to adjust the timing of ignition. Further, an OCV 137 is controlled in accordance with the operating states to control switching between the rocker arm 45 for high speed and the rocker arm 39 for low speed as described above.

This engine apparatus includes the engine 1 having the cam carrier 7 (7A-7D) which can improve the certainty of connection between the rocker arm 39 for low speed and the rocker arm 45 for high speed. Thus, the engine apparatus capable of acquiring desired operating states is realized.

Figure 17:
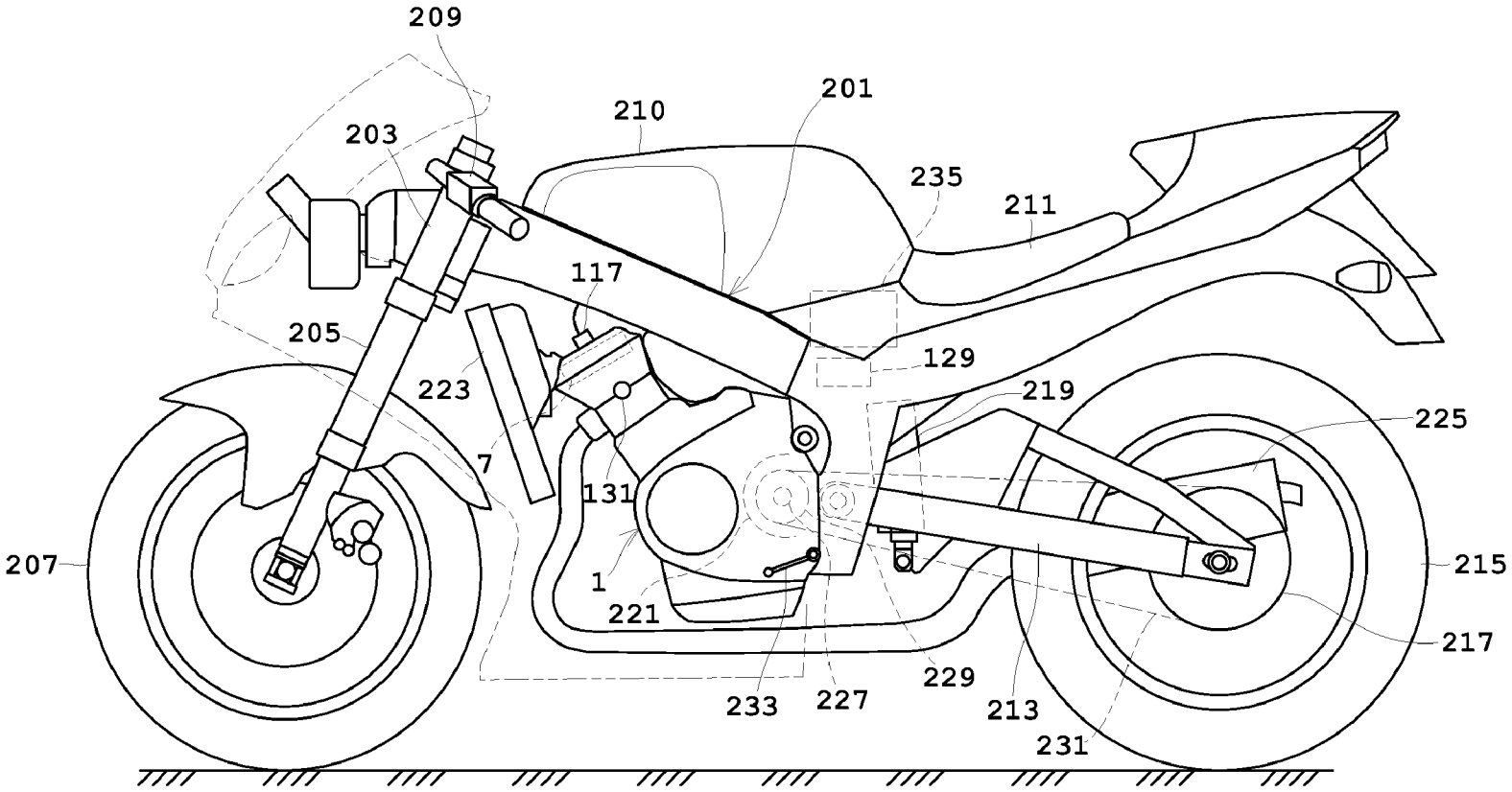
FIG. 17 is a view showing an outline construction of a two-wheeled motor vehicle according to a preferred embodiment of the present invention.

A two-wheeled motor vehicle will be described with reference to FIG. 17, as an example of transport machine including the above cam carrier 7 (7A-7D) and engine apparatus. FIG. 17 is a view showing an outline construction of a two-wheeled motor vehicle according to a preferred embodiment of the present invention.

A main frame 201 includes a head pipe 203 disposed at the front end thereof. A front fork 205 is attached to the head pipe 203 to be rockable right and left. A front wheel 207 is rotatably attached to lower ends of the front fork 205. A steering handle 209 is attached to the upper end of head pipe 203.

A fuel tank 210 is mounted on the main frame 201 rearward of the steering handle 209. A seat 211 is mounted further rearward of the fuel tank 210. Swing arms 213 are attached to the main frame 201 below the seat 211 to be swingable relative to the main frame 201. A rear wheel 215 is attached to rear ends of the swing arms 213 to be rotatable with a driven sprocket 217. A rear suspension 219 is disposed adjacent a fulcrum of the swing arms 213 to be held between the main frame 201 and swing arms 213.

The rear wheel 215 corresponds to the "drive wheel" in the present preferred embodiment of the present invention.

An engine 1 and a change gear 221 are arranged at the opposite side of the fuel tank 210 across the main frame 201. A radiator 223 is attached to the front of the engine 1. A muffler 225 which suppresses exhaust noise is attached to the rear end of an exhaust line extending rearward from the engine 1.

A drive sprocket 229 is attached to a drive shaft 227 of the change gear 221. A chain 231 extends between the drive sprocket 229 and driven sprocket 217. A shift pedal 233 is attached adjacent the change gear 221 for operating the change gear 221. The ECU 129 and a battery 235 are attached to a lower portion of the fuel tank 210.

The above change gear 221, drive shaft 227, drive sprocket 229 and chain 231 correspond to the "transmission mechanism" in this preferred embodiment of the present invention.

The above construction can realize a two-wheeled motor vehicle capable of acquiring desired operating states by transmitting power generated by the engine apparatus to the rear wheel 215 through the drive shaft 227 and so on.

Although a two-wheeled motor vehicle is shown as an example of the transport machine in this preferred embodiment of the present invention, the present invention may be applied to automobiles, personal watercraft, snowmobiles, boats and so on which are equipped with the engine apparatus and can transport people, baggage and so on.

As described above, various preferred embodiments of the present invention are suitable for a variable valve control apparatus for opening and closing valves provided for an engine, an engine apparatus, and a transport machine such as a two-wheeled motor vehicle.

While preferred embodiments of the present invention have been described above, it is to be understood that variations and modifications will be apparent to those skilled in the art without departing the scope and spirit of the present invention. The scope of the present invention, therefore, is to be determined solely by the following claims.

The invention claimed is:

1. A variable valve apparatus for switching a lift amount of a valve between a time of low speed and a time of high speed, the variable valve apparatus comprising:

a cam shaft supported rotatably and including, arranged around an axis thereof, a low speed cam and a high speed cam;

a rocker shaft spaced from the cam shaft and extending parallel or substantially parallel to the cam shaft;

a low speed rocker arm mounted on the rocker shaft to be rockable about an axis thereof, and which rocks in response to the low speed cam and pushes a stem end surface of the valve;

a through-hole formed in the low speed rocker arm and arranged to be parallel or substantially parallel to the rocker shaft;

a connecting pin slidably disposed in the through-hole;

an actuator arranged to move the connecting pin back and forth within the through-hole;

a high speed rocker arm mounted on the rocker shaft to be rockable about the axis thereof, and which rocks in response to the high speed cam; and an engaging portion arranged on the high speed rocker arm to engage the connecting pin projecting from the through-hole; wherein the low speed rocker arm includes:

a first cam receiver including a slipper surface slidable on the low speed cam, and a first side surface arranged in a direction depending from an end of the slipper surface; and a first connector including a second side surface located closer to the valve than is the first side surface and arranged perpendicular or substantially perpendicular to the rocker shaft, the first connector including the through-hole;

the high speed rocker arm includes:

a second cam receiver including a slipper surface slidable on the high speed cam, and a third side surface arranged in a direction depending from an end of the slipper surface; and a second connector integral with the second cam receiver and including a fourth side surface in a position opposed to the second side surface of the first connector, the second connector including the engaging portion;

the engaging portion includes a cylindrical engaging hole including a central axis extending axially of the rocker shaft; and the second connector includes a fifth side surface located below the fourth side surface to be further remote from the second side surface than is the fourth side surface, such that a width of the cylindrical engaging hole in a direction of the rocker shaft is narrower in a lower portion adjacent the valve than in an upper portion of the cylindrical engaging hole adjacent the slipper surface, and a guide surface located in a lower portion of the fourth side surface that defines an arc that is shorter than a semicircle and is coaxial and equal in radius with the engaging hole.

2. The variable valve apparatus according to claim 1, wherein the through-hole is located forward of a rear end of the slipper surface of the high speed rocker arm, as seen from an axial direction of the rocker shaft.

3. The variable valve apparatus according to claim 1, wherein, as seen from an axial direction of the rocker shaft, at least a portion of the through-hole is located within a range of a sector defined by an arcuate portion, on which the high speed cam slides, of the slipper surface of the high speed rocker arm, and a center of a circle providing an arc of the slipper surface of the high speed rocker arm.

4. The variable valve apparatus according to claim 1, wherein, as seen from an axial direction of the rocker shaft, at least a portion of the through-hole is located within a range of a sector defined by an arcuate portion, on which the stem end surface of the valve slides, of a valve-side slipper surface of the low speed rocker arm, and a center of a circle providing an arc of the valve-side slipper surface of the low speed rocker arm.

5. The variable valve apparatus according to claim 1, wherein:

as seen from an axial direction of the rocker shaft, at least a portion of the through-hole is located within a range of a sector defined by an arcuate portion, on which the high speed cam slides, of the slipper surface of the high speed rocker arm, and a center of a circle providing an arc of the slipper surface of the high speed rocker arm; and as seen from an axial direction of the rocker shaft, at least a portion of the through-hole is located within a range of a sector defined by an arcuate portion, on which the stem end surface of the valve slides, of a valve-side slipper surface of the low speed rocker arm, and a center of a circle providing an arc of the valve-side slipper surface of the low speed rocker arm.

6. An engine apparatus comprising the variable valve apparatus according to claim 1.

7. An engine apparatus comprising the variable valve apparatus according to claim 2.

8. An engine apparatus comprising the variable valve apparatus according to claim 3.

9. An engine apparatus comprising the variable valve apparatus according to claim 4.

10. An engine apparatus comprising the variable valve apparatus according to claim 5.

11. A transport machine comprising:

the engine apparatus according to claim 6;

a fuel tank arranged to store fuel;

a front wheel and a rear wheel; and a transmission mechanism arranged to transmit power generated by the engine apparatus to the rear wheel.

12. A transport machine comprising:

the engine apparatus according to claim 7;

a fuel tank arranged to store fuel;

a front wheel and a rear wheel; and a transmission mechanism arranged to transmit power generated by the engine apparatus to the rear wheel.

13. A transport machine comprising:

the engine apparatus according to claim 8;

a fuel tank arranged to store fuel;

a front wheel and a rear wheel; and a transmission mechanism arranged to transmit power generated by the engine apparatus to the rear wheel.

14. A transport machine comprising:

the engine apparatus according to claim 9;

a fuel tank arranged to store fuel;

a front wheel and a rear wheel; and a transmission mechanism arranged to transmit power generated by the engine apparatus to the rear wheel.

15. A transport machine comprising:

the engine apparatus according to claim 10;

a fuel tank arranged to store fuel;

a front wheel and a rear wheel; and a transmission mechanism arranged to transmit power generated by the engine apparatus to the rear wheel.

* * * * *